US006073086A

United States Patent [19]

Marinelli

[11] Patent Number: 6,073,086

[45] **Date of Patent: *Jun. 6, 2000**

[54] TIME OF MOTION, SPEED, AND TRAJECTORY HEIGHT MEASURING DEVICE

[75] Inventor: Dave Marinelli, Superior, Colo.

[73] Assignee: Silicon Pie, Inc., Superior, Colo.

[ * ] Notice: This patent is subject to a terminal disclaimer.

[21] Appl. No.: 09/007,240

[22] Filed: Jan. 14, 1998

[51] Int. Cl.[7] ..... G06F 15/00

[52] U.S. Cl. ..... 702/141; 702/142; 702/149; 473/198; 473/200; 473/570

[58] Field of Search ..... 702/141, 149, 702/142; 473/200, 198, 570

[56] References Cited

U.S. PATENT DOCUMENTS 4,775,948 10/1988 Dial et al. ..... 364/565
5,526,326 6/1996 Fekete et al. ..... 368/10
5,564,698 10/1996 Honey et al. ..... 273/128 R
5,761,096 6/1998 Zakutin ..... 364/565
5,779,576 7/1998 Smith, III et al. ..... 473/570

*Primary Examiner*—Marc. S. Hoff
*Assistant Examiner*—Hien Vo
*Attorney, Agent, or Firm*—James R. Young

[57] ABSTRACT

A device for measuring the time of flight, speed, and trajectory height of a projectile, such as a baseball, football, hockey puck, or model rocket, or the time and speed of swing of a movable object, such as a baseball bat or golf club. Part of the device, called the object unit, is embedded, secured, or attached to the projectile or movable object of interest, and consists of an acceleration sensor, threshold circuit, and a radio transmitter. The other part of the device, called the monitor unit, is held or worn by the user and serves as the user interface for the device. The monitor unit has a radio receiver, a processor, an input keypad, and a display that shows the various measured motion characteristics of the projectile or movable object, such as distance, time of flight, speed, and trajectory height, and allows the user to input data to the device.

42 Claims, 13 Drawing Sheets

TIME OF MOTION, SPEED, AND TRAJECTORY HEIGHT MEASURING DEVICE

CROSS REFERENCE TO RELATED APPLICATIONS

This application is related to application Ser. No. 09/007,241 of Dave Marinelli filed on Jan. 14, 1998 entitled A Speed, Spin Rate, and Curve Measuring Device.

FIELD OF THE INVENTION

This invention relates to measuring motion characteristics of movable objects and more particularly to measuring time, speed, and/or trajectory height of a movable object. Even more particularly, the invention relates to measuring the time and speed of swing of a movable object, such as a baseball bat or golf club, or the time of flight, speed, and trajectory height of a projectile, such as a baseball, football, hockey puck, or model rocket, by utilizing an embedded movable object unit and an external monitor unit.

BACKGROUND OF THE INVENTION

Participants of many sports, including baseball, football, soccer, hockey, and golf, and their coaches, are often interested in knowing the motion characteristics of the object used in a sport, such as the distance, speed, time of flight, or height of thrown, kicked, or batted balls and slapped hockey pucks, or the speed of swing of a baseball bat or golf club. Typically, the speed of a moving ball is measured using a Doppler Radar System. Doppler Radar Systems determine a projectile's speed by analyzing radar beams reflected off the projectile. Although accurate, these systems are expensive and normally cannot be operated by the athlete whose toss or hit is being measured. For these reasons, systems of this type are generally restricted to organized sport teams.

Several other methods for measuring the motion characteristics of moving objects have been proposed over the years that rely on devices wholly external to the moving object. Another approach to the problem involves placing a measurement device within the moving object. Two such systems are described in U.S. Pat. No. 4,775,948 issued on Oct. 4, 1988 to Dial et al. entitled "Baseball Having Inherent Speed-Measuring Capabilities", the '948 patent, and U.S. Pat. No. 5,526,326 issued on Jun. 11, 1996 to Fekete et al. entitled "Speed Indicating Ball", the '326 patent. The '948 patent involves placing an electronic timer and calculator within the ball. The timer measures the ball's time of flight over a measured distance, and on that basis determines the ball's speed. It then displays the speed on the surface of the ball via a liquid crystal display. The '326 patent suggests that a more economical and durable method of accomplishing the same task is met by using mechanical means internal to a ball for determining time of flight and speed.

Neither of these systems previously proposed, however, combine the desirable characteristics of being economical, durable, simple to operate by the athlete, and transparent to that athlete in terms of the feel of the ball and the ball's performance. The embedded electronic timer with an LCD display proposed in the '948 patent is vulnerable to strikes against the ground, a glove, or a bat, and is very difficult to manufacture without altering the balance, feel, and motion characteristics of a ball. The mechanical solution proposed in the '326 patent claims to be more durable, but alters a ball's physical characteristics even more because of its voluminous design. In addition, it splits a ball into two halves that must be wound relative to each other by the player. The two halves must be held in this position until released in a toss. This design is not transparent to the user and alters the physical, balance, and motion characteristics of a ball significantly. Also, the mechanical design cannot be applied to moving objects that are not held by a player, such as a hockey puck.

It is thus apparent that there is a need in the art for an improved method or apparatus which does not significantly or materially alter the moving object in question's physical characteristics or flight or swing performance, is inexpensive, durable, applicable to many different types of sports equipment and other projectiles, measures many different motion characteristics, and is operable by the person doing the throwing, kicking, hitting, or batting. The present invention meets these and other needs in the art.

This application is related to application Ser. No. 09/007,241 of Dave Marinelli filed on Jan. 14, 1998 entitled A Speed, Spin Rate, and Curve Measuring Device, which is incorporated herein by reference for all that is disclosed and taught therein.

SUMMARY OF THE INVENTION

It is an aspect of the present invention to measure the time of motion, speed, and trajectory height of a movable object utilizing an attached object unit in the movable object that emits radio signals and an external monitoring unit that receives radio signals.

It is another aspect of the invention to utilize modulated radio frequencies with an identification code to minimize interference.

Yet another aspect of the invention is to be able to measure a plurality of movable objects with a plurality of attached object units and at least one monitor unit.

Still another aspect of the invention is to filter out acceleration events that fall below a minimum g-force level.

A further aspect of the invention is to distinguish acceleration events that have differing durations.

A still further aspect of the invention is to distinguish acceleration events that have different g-force levels.

Another aspect of the invention is to activate the projectile unit by sending a radio signal from a transmitter located in the monitor unit to a receiver located in the projectile unit.

A still another aspect of the invention is to measure motion characteristics of a movable object in such a way as to not significantly alter the physical characteristics and flight performance of the movable object being measured.

The above and other aspects of the invention are accomplished in a device for measuring the motion characteristics, such as distance, time of flight, speed, and trajectory height of a projectile, such as a baseball, football, hockey puck, or model rocket or the time and speed of swing of a movable object, such as a baseball bat or golf club. Part of the device, called the object unit (also referred to as the projectile unit), is embedded, secured, or attached to the movable object of interest. The other part of the device, called the monitor unit (also referred to as the receiving unit), is held or worn by the user and serves as the user interface for the device. The monitor unit displays the various measured motion characteristics of the movable object and allows the user to input data to the device.

The object unit has an acceleration sensor, battery, and radio transmitter that can be wholly and invisibly embedded, secured, or attached in the center of a solid projectile, such as a ball or puck; attached or suspended inside a deformable projectile, such as a football, soccer ball, or tennis ball; attached inside a hollow non-deformable projectile, such as a model rocket; or embedded, secured, or attached in the end of a baseball bat or golf club. Its size and construction can yield a baseball, football, puck, model rocket, baseball bat, or golf club that looks, feels, flies, and swings as normal baseballs, footballs, pucks, model rockets, baseball bats, or golf clubs.

The monitor unit provides a readout of distance, time of flight, trajectory height, and speed or swing speed data. The monitor unit has a radio receiver, a processor, output display, and a keypad for user input. It may be constructed similar to a wristwatch, stopwatch, or a pocket sized calculator for portability, and can provide visual or audio readouts.

BRIEF DESCRIPTION OF THE DRAWINGS

The above and other aspects, features, and advantages of the invention will be better understood by reading the following more particular description of the invention, presented in conjunction with the following drawings, wherein.

DESCRIPTION OF THE PREFERRED EMBODIMENT

The following description is of the best presently contemplated mode of carrying out the present invention. This description is not to be taken in a limiting sense but is made merely for the purpose of describing the general principles of the invention. The scope of the invention should be determined by referencing the appended claims.

Figure 1:
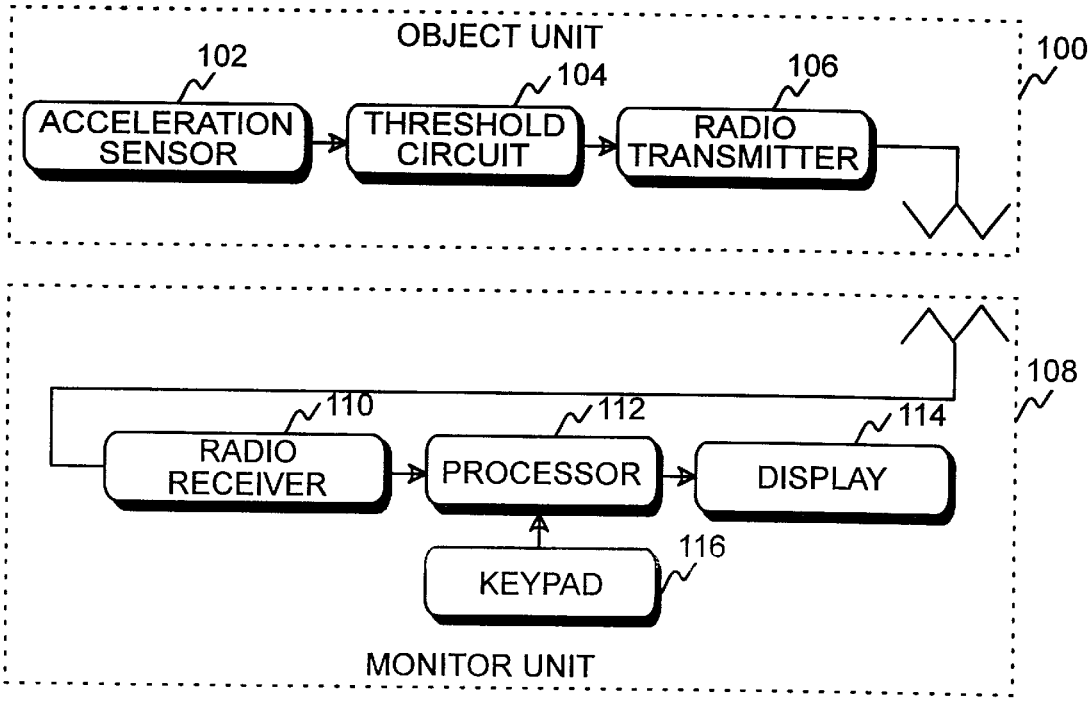
FIG. 1 shows a block diagram of a device for measuring the time of motion, speed, and trajectory height of a projectile of the present invention.

FIG. 1 shows a block diagram of a device for measuring the time of motion, speed, and trajectory height of a movable object. Referring now to FIG. 1, the invention described consists of two main parts: object unit 100 and monitor unit 108. Object unit 100 has an acceleration sensor 102 that communicates through threshold circuit 104 to radio transmitter 106. Acceleration sensor 102, embedded along with the other components of object unit 100 within or attached or secured to a movable object, detects acceleration events. Acceleration sensor 102 may be an electronic device called an accelerometer and may be of the following types: piezoelectric, mechanical, micro-machined silicon chip, or any other type small enough to be embedded in a movable object. The acceleration sensor can be what is sometimes referred to as a shock, impact, or motion sensor. The acceleration sensor may have the threshold capability built in, as would a mechanical switch sensor.

An accelerometer is capable of detecting and signaling the acceleration that occurs during a movable object's trajectory, and is designed for the specific application in mind. For a baseball, for example, a three axis accelerometer is able to give an indication of acceleration in any of the 3 axis directions. For measuring the speed of a pitched baseball, the accelerometer and associated circuitry is tuned to detect acceleration levels consistent with and indicative of the ball being pitched, caught, or hit. For a hockey puck the accelerometer need only be two axis, detecting acceleration in a two-dimensional plane.

It may be advantageous to use two different types of sensors. For example, in a baseball, a mechanical sensor might be used to detect 'use' of the ball to turn on the internal circuitry, whereas micro-machined silicon sensors might be used to detect acceleration events associated with the pitches, hits, or kicks to be measured. In this example, the mechanical switch provides the advantage of requiring zero power for its operation. The silicon sensors, unlike a mechanical on/off switch sensor, can provide an output proportional to the acceleration force.

When acceleration sensor 102 detects acceleration indicative of a punt, slap shot, blast off, pitch, catch, hit, or swing, it stimulates radio transmitter 106 to transmit a signal, an 'event marker', to monitor unit 108, which is external to object unit 100. The event marker is received by radio receiver 110 and a time stamp is set by monitor processor 112. For example, monitor processor 112 could calculate the velocity of a pitch using two pieces of information: 1) the amount of time between successive acceleration events, and 2) the distance between the pitcher and the catcher. The distance between the pitcher and the catcher must be provided by the user to monitor processor 112 via manual entry through input keypad 116 or, alternatively, using a remote distance measuring device such as an ultrasonic based measure (not shown in FIG. 1). After each event, monitor unit 108 may display the calculated speed in output display 114.

Regarding the time between successive acceleration events and the nature of the acceleration sensors used, the processor may contain an adjustment factor for time based upon the application. For example, in a baseball pitch, the point at which an acceleration event is detected in the windup and release of the baseball will affect the speed calculation. Simultaneous testing of the device with a Doppler radar system can be used to determine whether an adjustment for time, either adding or subtracting a few milliseconds, is necessary for the device to accurately calculate and display the actual speed of the baseball.

Also, adjustment factors may be applied to the average speed to display an estimate of the peak velocity of a ball (the initial velocity when the ball left the pitcher's hand), or the minimum velocity (the final velocity when the ball is caught). A tossed ball loses speed as it travels due to air resistance. The amount of speed loss varies for varying average speeds. For a pitch having an average speed of ninety miles per hour, one mile per hour loss in speed per seven feet traveled is a good approximation. Hence, the peak and minimum velocities of a pitched baseball can be estimated by the following equations:

Peak Velocity $$V_p=V_a+0.5(d/l)$$

Minimum Velocity $$V_m=V_a-0.5(d/l)$$

where $V_p$=peak velocity in miles per hour $V_m$=minimum velocity in miles per hour $V_a$=average velocity in miles per hour d=distance covered in flight in feet l=velocity loss due to air resistance in feet/miles per hour;

The value of 1 depends upon the type of ball and the average speed of a pitch. The monitor processor will select a value of 1 using a lookup table or a mathematical calculation. For a baseball thrown at an average speed of 90 MPH over a distance of 60 feet, l is 7 and $V_m$ is calculated as shown below:

$$V_m=90-0.5(60/7)=86 \text{ MPH}$$

This calculation yields a speed that better matches the reading of an accurate Doppler Radar that displays the velocity of a pitch as it crosses home plate than does the average speed calculation. For whatever speed is calculated—average, peak, or minimum—the monitor updates the speed and flight time after receiving the appropriate acceleration event markers.

Monitor unit 108 can be used to provide information other than velocity. It can provide time of flight and altitude information as well. In fact, these two trajectory statistics are independent of the horizontal distance traversed by the projectile containing object unit 100. Time of flight is simply obtained by measuring the amount of time between acceleration events. This raw data is used in the velocity calculation. Provided that the launch altitude is equivalent to the landing altitude (or reasonably so with respect to the trajectory height) the projectile trajectory's maximum altitude can be calculated by the monitor unit and displayed to the user.

The equation that describes the vertical distance covered by a falling object is given below:

$$d=(1/2)at^2$$

Where:

d=distance covered by the falling object (in inches)

a=acceleration due to gravity (32.2 feet/sec$^2$)

t=flight time—from the moment the object was released to the moment it hits the ground (in seconds).

It is also generally true that the fall time of an object that is catapulted is equal to its rise time. That is, the time it takes for a football to reach its maximum vertical height in a punt is equal to the time it takes for the ball to fall back to the ground, provided that the ball lands on the same stationary plane from which it was kicked. (Catching the ball 4 feet off the ground will result in a calculated altitude that is about 2 feet less than actual.) Hence, the vertical height h of a punted football with total air time $t_a$ is given by the following equation:

$$h=(1/8)at_a^2$$

Adjustment factors may be applied to account for air resistance and/or initial launch altitude.

Since neither monitor unit 108 nor the ball's embedded acceleration sensor 102 can distinguish between an acceleration event that denotes the beginning of projectile flight and an event that denotes the end of projectile flight, additional information may be required from the user to capture and preserve trajectory information of interest.

For example, if a batter wishes to know the altitude of a hit fly ball, monitor unit 108 could be programmed to capture and hold the statistics for the second segment of a multi-segment trajectory. The pitch by the pitcher generates an event marker. The contact with the batter's bat generates the second event marker and denotes the beginning of the second segment. The landing of the ball on the ground or in a fielder's glove generates another event marker that denotes the end of the second segment. At this point, monitor unit 108 can calculate the maximum altitude attained by a fly ball and display it on output display 114 for the user. It will ignore all further acceleration events (possibly arising from subsequent bounces on the ground) until the user sets monitor unit 108 for another measurement.

In calculating the speed of a pitched baseball by using acceleration sensor 102 within the baseball, two techniques are available: 1) the output of g-force proportional sensors can be integrated over time to arrive at the speed of the ball at any point in time during the flight of a pitched ball from pitcher to catcher, and 2) acceleration sensor 102 can detect the beginning of flight and the end of flight and monitor processor 112 can determine the time elapsed between those two events and calculate the average flight speed using the elapsed time and the distance between the pitcher and the catcher. This invention uses the second technique. There are three keys to this approach.

1. The ability to detect the endpoints of the flight and to distinguish the endpoints of the flight from acceleration events that are unrelated to the speed statistic of interest.
2. The radio frequency signaling by object unit 100 from within the projectile to external monitor unit 108. This allows for total embedding, securing, or attaching of object unit 100 within the projectile in a transparent manner.
3. The radio frequency signaling that occurs in real time (during a pitch, for example) immediately upon detection of an acceleration event. This allows monitor unit 108 to accurately measure the elapsed time between acceleration events and to use that information along with other information provided directly by the user to calculate the average flight speed or other trajectory statistics. This factor becomes irrelevant, however, if the object unit transmits the elapsed time between two acceleration events.

G-force proportional output can be used by a processor within object unit 100 (not shown in FIG. 1) or threshold circuit 104 to make intelligent decisions about the projectile's trajectory, such as when a baseball pitch was started (arm motion begun) versus when the ball was released from the pitcher's hand.

Another aspect of the accelerometer choice is one of economics. Two-dimensional accelerometers are more prevalent and less costly than three-axis sensors. For a baseball, ideally the sensor would be capable of sensing acceleration along all three axes. However, it may be possible to get accurate speed measurement results for 75% of the pitches by using a sensor capable of only two axis detection. For children at play, a two axis detector may be good enough. For professional ball teams, a three axis detector that yields speed measurement results on every pitch may be worth the extra cost of the enhanced accelerometer.

A solid core is found at the heart of each regulation baseball or softball. Also, a hockey puck consists of a solid hard rubber material. Ideally, object unit 100 will be embedded in a core material that matches the weight characteristics of the regulation core. An epoxy resin might be used. It is important to position and orient acceleration sensor 102 so that centrifugal forces resulting from the spinning of the ball will not trip threshold circuit 104 detection. To accomplish this, acceleration sensor 102 should be positioned at or near the center of a ball.

The antenna for radio transmitter 104 should be fully contained within the core also. The final product must be impervious to summer heat, winter cold, and the tremendous g-forces resulting from fast pitches, kicks, hockey slap shots, swings, or model rocket blast offs. Another challenge is to maintain the symmetrical balance of a ball, puck, bat, golf club, or model rocket. Embedding object unit 100 within a deformable projectile such as a football or soccer ball is more difficult unless the ball has a foam core and is just a facsimile of a real ball. In an air-filled ball the object unit could be suspended in the center using strings or fabric webbing.

Monitor unit 108 has radio receiver 110 that communicates with monitor processor 112. Input keypad 116 inputs information to monitor processor 112, and monitor processor 112 sends information to output display 114. Object unit 100 communicates with monitor unit 108 through radio transmitter 106 and radio receiver 110.

Figure 2:
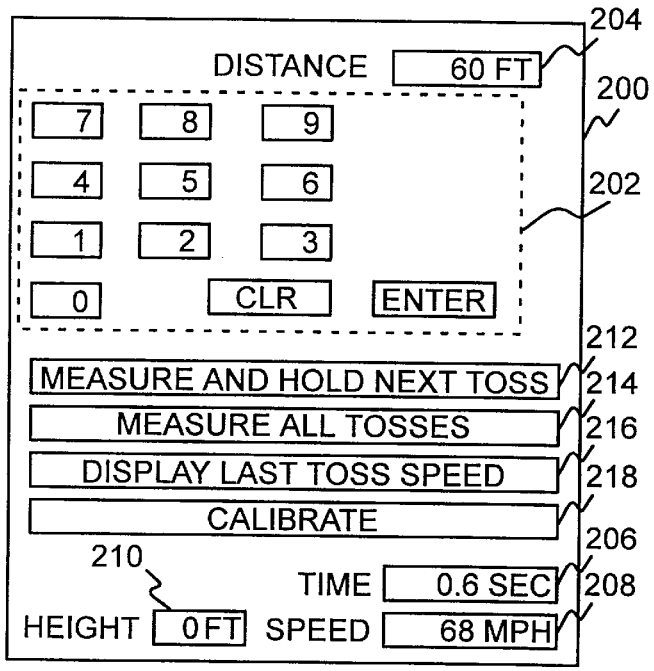
FIG. 2 shows an embodiment of the face of the monitor unit of the present invention.

FIG. 2 shows an embodiment of the face of monitor unit 108 of the present invention. Referring now to FIG. 2, face 200 of monitor unit 108 (FIG. 1) has numeric keypad 202 where the user may input information, such as the distance between a pitcher and a catcher. There are four displays. Distance display 204 shows the distance between two points, such as a pitcher and a catcher, that has been entered through numeric keypad 202. Time display 206 shows the time of flight of a projectile or the swing time of a bat or club as calculated by monitor processor 112 (FIG. 1). Speed display 208 shows the speed of a projectile or the speed of the end of a bat or club as calculated by monitor processor 112 (FIG. 1). Height display 210 shows the height of a projectile, such as a batted baseball or punted football, as calculated by monitor processor 112 (FIG. 1).

Measure all tosses button 214 is used to select the measure all tosses capability. To measure the speed of a pitched baseball using this capability, the pitcher or catcher would perform the following operations:

1. Throw a warm-up pitch to activate the embedded electronics (assuming that a motion based activation system is used).
2. Enter the distance in feet between the pitcher and catcher using numeric keypad 202.
3. Press measure all tosses button 214.
4. Deliver the ball to the pitcher.
5. Pitch and catch the ball.
6. Look at the displayed speed in speed display 208 before jarring the ball again.
7. Continue repeating steps 5 through 6 as desired.

In this mode of operation, processor 112 calculates a new value for display in speed display 208 each time an acceleration event marker is received from the ball. The speed is calculated simply by dividing the distance value that was entered by the time that has elapsed since the last acceleration event marker was registered. Therefore, if after the pitch is caught, the ball is dropped by the catcher, the displayed speed will be in error if the dropping of the ball resulted in an acceleration event.

Measure and hold next toss button 212 is used to select the measure and hold next toss capability. To measure the speed of a pitched baseball using this capability, the pitcher or catcher would perform the following operations:

1. Throw a warm-up pitch to activate the embedded electronics (assuming that a motion based activation system is used).
2. Enter the distance in feet between the pitcher and catcher using numeric keypad 202.
3. Deliver the ball to the pitcher.
4. Press measure and hold next toss button 212.
5. Pitch and catch the ball.
6. Look at the displayed speed.
7. Continue repeating steps 4 through 6 as desired.

There is no need to avoid jarring the ball in this mode as further acceleration events will be ignored and the speed for the pitch of interest is captured and held until one of the option buttons is pressed again. This mode allows a pitcher to throw the ball against a wall and have it bounce on the ground, creating additional acceleration events, and still retain the speed statistic for the pitch.

In this mode of operation, the elapsed time between the two acceleration event markers received following depression of measure and hold next toss button 212 is used in the speed calculation. Subsequent acceleration events will not affect the displayed speed statistic.

Display last toss speed button 216 is used to select the display last toss speed capability. Whenever this option button is pressed, the speed of the projectile is calculated based upon the two most recent event time stamps. The time stamps for the two most recent event markers are saved. This button would be pressed following a pitch and catch and before the ball is exposed to any jarring events, such as being dropped or tossed back to the pitcher.

Calibrate button 218 is used to select the calibrate capability. For best performance (the fewest misinterpreted acceleration events), the acceleration thresholds must be tuned to each application (baseball, football, hockey, model rocket, etc.) and each user. Some of the signaling and threshold strategies described below in FIGS. 3 through 15 do not permit the user to do any customization. Nevertheless, these simple realizations may work well, especially if the invention is sold in separate children's and adult's versions that have pre-set thresholds appropriate for each. Also discussed in FIG. 11 below is a signaling strategy that allows a user to set the invention to their own speed range. The implementation of an automatic calibration capability utilizing calibration button 218 is a third option.

An automatic calibration capability can be provided with an embodiment of the invention that transmits g-force information to monitor unit 108 as outlined in FIGS. 9 through 13. Monitor unit 108 would have calibrate button 218 on face 200. Use of the feature is described below:

1. The pitcher or catcher enters the distance between the two players with numeric keypad 202.

2. The pitcher pitches the ball to the catcher.
3. The catcher must hold onto the ball and not subject it to any large acceleration events, such as tossing it or dropping it, until after calibrate button 218 is pressed.
4. Press calibrate button 218.
5. Monitor unit 108 interprets the previous two acceleration events as typical of the pitcher's tosses and calculates the speed for the pitch.

At this point monitor unit 108 has three statistics related to the pitcher's typical toss:

1. typical pitch event g-force level.
2. typical catch event g-force level.
3. typical average speed.

Monitor unit 108 will develop an acceptable range for each of the three statistics. These ranges will be used to distinguish tosses for which the speed must be calculated and displayed from unrelated acceleration events that are not of interest to the user. For example, the typical values captured when calibrate button 218 is pressed are as follows:

1. typical pitch event g-force level=10 Gs.
2. typical catch event g-force level=1000 Gs.
3. typical average speed=75 MPH.

The following ranges are developed which bracket the typical values above:

1. acceptable pitch event range=5–15 Gs.
2. acceptable catch event range=700–1300 Gs.
3. acceptable average speed range=60–90 MPH.

Monitor unit 108 will interpret two successive acceleration events as resulting from the pitcher's toss only if the first event was between 5 and 15 Gs, the second event was between 700 and 1300 Gs, and the calculated average speed was between 60 and 90 MPH. If these three conditions are true, the speed display is updated with the computed value.

Although most pitching rubbers are placed a regulation distance from home plate, sometimes the distance must actually be measured prior to use of the invention to assure accurate results. In one embodiment of the invention, this measurement can be facilitated by placing an ultrasonic wave transmitter/receiver within monitor unit 108 that communicates with monitor processor 112, and locating the monitor unit at the measuring start or end point of interest. Whenever the measure button (not shown in FIG. 2) is pressed on the monitor unit, the distance measured from the start point to the end point will appear in distance display 204 and will subsequently be used in the speed calculations. For example, the catcher may have monitor unit 108 with the ultrasonic wave transmitter. The catcher would aim the ultrasonic wave transmitter at the pitcher, press the measure button, and the distance between the catcher and pitcher will appear in distance display 204. Alternatively, a separate ultrasonic wave transmitter with its own readout could be used, and the distance manually entered via numeric keypad 202.

Figure 3:
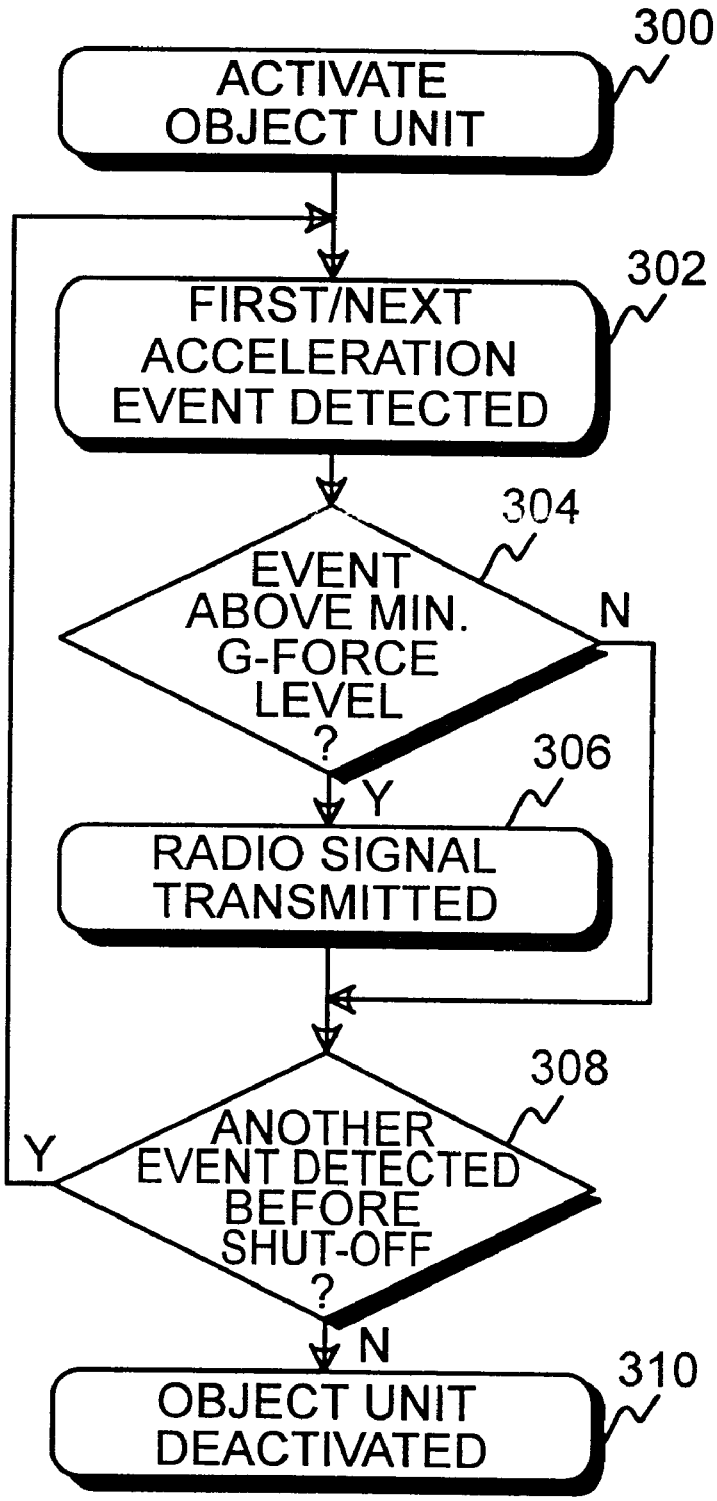
FIG. 3 shows a block diagram of a non-modulated radio transmission with a single threshold level by the object unit.

FIG. 3 shows a block diagram of an embodiment of the invention that employs a non-modulated radio transmission with a single threshold level by object unit 100. Referring now to FIG. 3, in block 300 object unit 100 (FIG. 1) is activated. Since the electronics embedded within object unit 100 are not accessible to the user, battery conservation is paramount. For a baseball there can be no physically accessible switch to turn the unit on or off as this would compromise the physical attributes of the baseball. Aside from employing low power design techniques and components, four strategies may be used to facilitate a long useful life for the embedded electronics.

1. Usage Detector With Auto-Shutoff—For a baseball, for example, it is possible to detect usage by way of motion. Motion sensing may be done using the same acceleration detectors used to detect pitches or, if useful for further energy conservation, a different type of sensor such as a mechanical on/off switch that is triggered by motion could be used. Once triggered, the circuit will remain 'alive' in a higher energy usage state for a limited amount of time, say one minute, unless motion is again detected before the minute expires, in which case the circuit is alive again for another minute.
2. RF Remote Control On Switch With Auto-Shutoff—The object unit would contain an RF receiver as well as a transmitter. The monitor unit would contain an RF transmitter as well as a receiver. When the user presses a "TURN ON BALL" button on the monitor unit (not shown in FIG. 2), an RF signal is sent to the object unit that turns on the projectile's internal electronics. Once on, the circuit would remain on as long as acceleration events were detected within a specific interval, such as one minute. If one minute passes without an acceleration event, the circuit would shut itself off and could only be re-awakened by the user pressing the "TURN ON BALL" button again.
3. Magnetically Coupled Switch With Auto-Shutoff—Application of an external magnet to a specific spot on the surface of a baseball, for example, would trigger a magnetically sensitive switch that would turn on the internal electronics. Once on, the circuit would remain on as long as acceleration events were detected within a specific interval, such as one minute. If one minute passes without an acceleration event, the circuit would shut itself off and could only be re-awakened by application of the magnet.
4. Inductively Coupled Charging Circuit—An internal rechargeable battery could be charged by transferring energy inductively from a coil external to the object unit to a receiving coil internal to the object unit. This implies that an inductive charging unit is provided with the invention and that the object unit must occasionally be placed in the inductive charger.

In block 302 a first or subsequent acceleration event is detected by acceleration sensor 102 (FIG. 1). Threshold circuit 104 (FIG. 1) in block 304 tests to see if the acceleration event is above a predetermined minimum g-force level. The g-force levels measured within a projectile or movable object by an acceleration sensor are dependent upon the type of projectile or movable object and the user of the projectile or movable object. For instance, the g-forces internal to a baseball that is pitched by an eight year old child are different than a hard pitch by a professional baseball player, and both are different from the g-forces internal to a football that is punted. Fortunately, the g-forces resulting from a pitch or a catch are significantly greater than those forces resulting from pitching windup motions or dropped balls. This is especially true of a baseball catch event. This means that uninteresting events can be filtered out and ignored by a simple threshold strategy.

For a baseball, the threshold level must be sufficiently low enough to detect pitches as well as catches but high enough to filter out irrelevant events. Each application of the invention would have to have its own minimum level set based on the characteristics of the projectile in question. Referring back to block 304, if the minimum g-force level is not reached, control passes to block 308. If the minimum g-force level is reached, then in block 306 a single non-modulated radio signal event marker is transmitted for a fixed period of time (significantly shorter than the typical flight or swing time). In block 308, if another acceleration event is detected before the predetermined shut-off time (typically one minute), then control returns to block 302. If not, control passes to block 310 where object unit 100 is deactivated through its shut-off circuitry.

Figure 4:
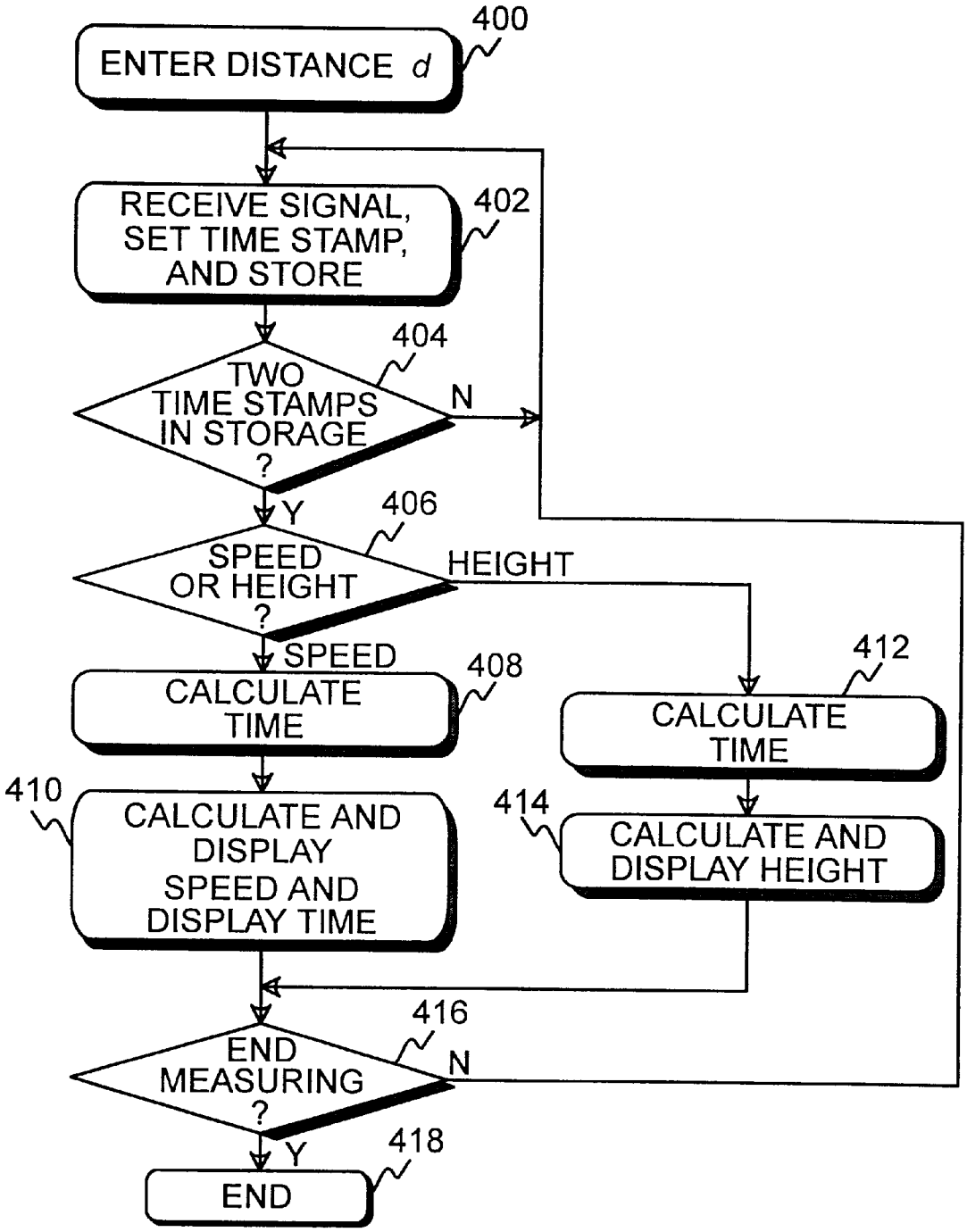
FIG. 4 shows a block diagram of a non-modulated radio transmission with a single threshold level by the monitor unit.

FIG. 4 shows a block diagram of an embodiment of the invention that employs a non-modulated radio transmission with a single threshold level by monitor unit 108. Referring now to FIG. 4, in block 400 the user enters through numeric keypad 202 (FIG. 2) the distance d between two points where characteristics of the object containing object unit 100 (FIG. 1) are desired to be measured. For a baseball pitch, the distance between the pitcher and catcher would be entered. For a golf club or baseball bat swing, the distance traveled by the object unit located in the end of the club or bat in the course of the swing would be entered. This distance may be more difficult to obtain and may be only a rough approximation.

In block 402 radio receiver 110 (FIG. 1), which is tuned to the same frequency as radio transmitter 106 (FIG. 1) of monitor unit 108, receives the radio signal event marker sent from radio transmitter 106 from FIG. 3. A time stamp is set and stored in a first position upon receiving the signal. The time stamp is subsequently used in the calculation of the object's speed or other trajectory statistics. Interference between nearby objects under simultaneous use can be avoided by producing objects that use several different frequencies and avoiding the use of objects with the same frequency in close proximity.

Upon receiving the next signal event marker from radio transmitter 106, the time stamp in the first position is moved to a second position and the new signal's time stamp is stored in the first position. Upon receipt of the next signal, the time stamp in the first position is moved to the second position, overwriting the time stamp that was already there, and the most recent signal's time stamp is stored in the first position. This queuing process is repeated each time a new signal event marker is received.

In block 404 a check is made to determine if there are two time stamps in storage. If not, control returns to block 402. If two time stamps are in storage, control passes to block 406 which determines whether the speed or the height of trajectory of the object is to be calculated. If trajectory height is to be calculated, control passes to block 412 where the time stamp stored in the second position is subtracted from the time stamp stored in the first position to determine the total air time of the projectile containing embedded object unit 100. Then in block 414 the formula $h=(1/8)at_a^2$ is used to calculate the height of the trajectory achieved by the projectile and the height is shown in height display 210 (FIG. 2).

If speed of the object thrown or swung is to be calculated as determined in block 406, control passes to block 408 where the time stamp stored in the second position is subtracted from the time stamp stored in the first position to determine the time of flight or time of swing of the object containing embedded object unit 100. Then in block 410 the distance d from block 400 is divided by the time of flight or time of swing from block 408 to determine the speed of the projectile or object, and the speed and time of flight or time of swing are shown in speed display 208 (FIG. 2) and time display 206 (FIG. 2). After displaying either trajectory height or speed and time, control passes to block 416 to determine if measuring of more acceleration events is to end. If not, control returns to block 402 to receive more signals. If yes, block 418 ends the operation of the invention.

Figure 5:
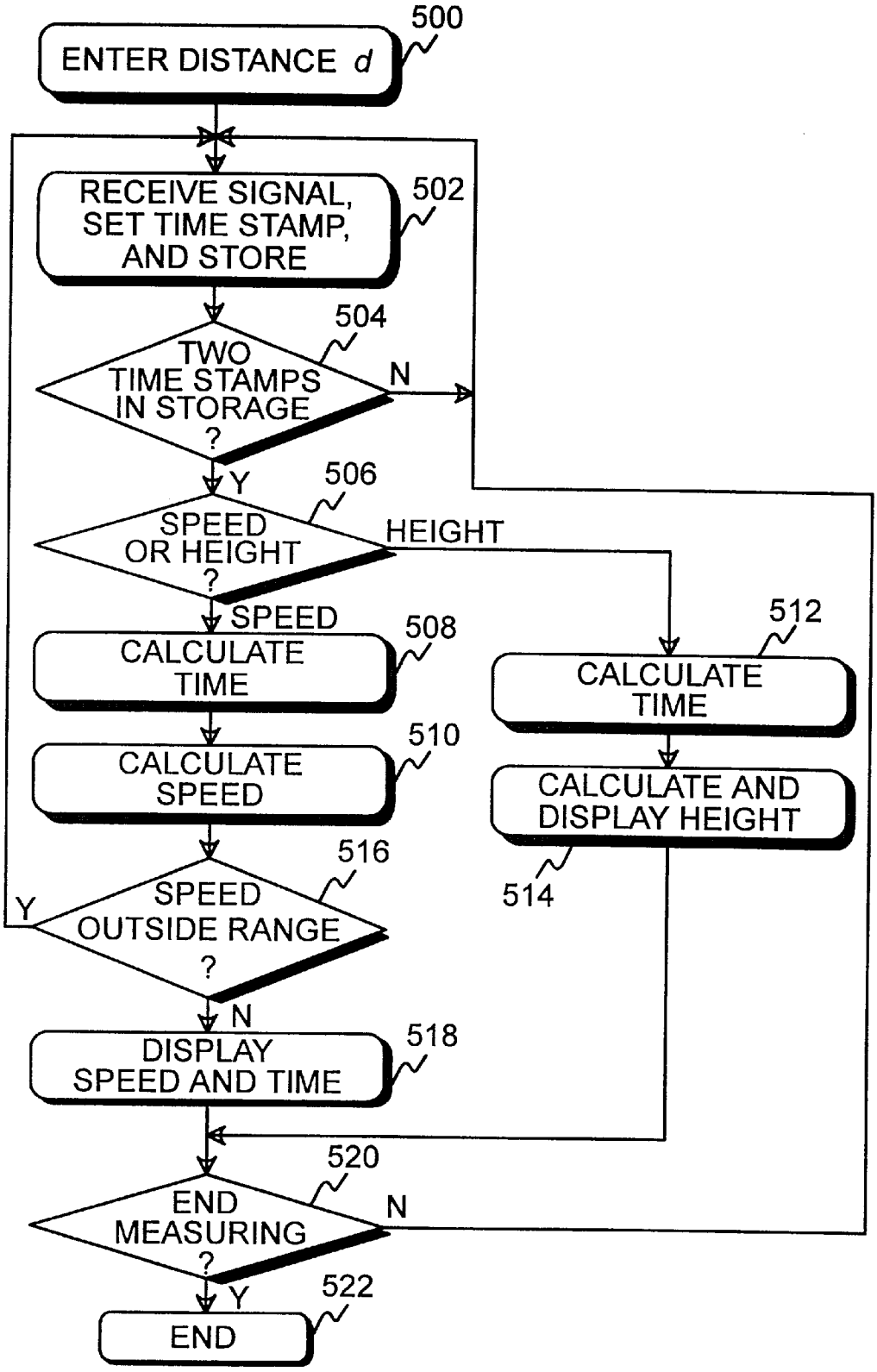
FIG. 5 shows a block diagram of another embodiment of a non-modulated radio transmission with a single threshold level by the monitor unit.

FIG. 5 shows a block diagram of another embodiment of a non-modulated radio transmission with a single threshold level by monitor unit 108. Referring now to FIG. 5, the description of blocks 500, 502, 504, 506, 508, and 512 is the same as shown in FIG. 4 in corresponding blocks 400, 402, 404, 406, 408, and 412.

In block 514, after using the height formula to calculate the trajectory height and then displaying the same, control passes to block 520 to determine if measuring is to end. If not, control returns to block 502 to receive the next signal event marker. If yes, block 522 ends the operation of the invention.

In block 510, after calculating the speed, control passes to block 516 where a check is made to determine if the speed falls outside a predetermined range, such as 60–100 MPH for a baseball pitch. If the answer in block 516 is yes, control returns to block 502 to receive the next signal event marker. If not, block 518 displays the time of flight in time display 206 (FIG. 2) and speed in speed display 208 (FIG. 2). Control then passes to block 520 to determine if measuring is to end. If not, control returns to block 502 to receive the next signal event marker. If yes, block 522 ends the operation of the invention.

Figure 6:
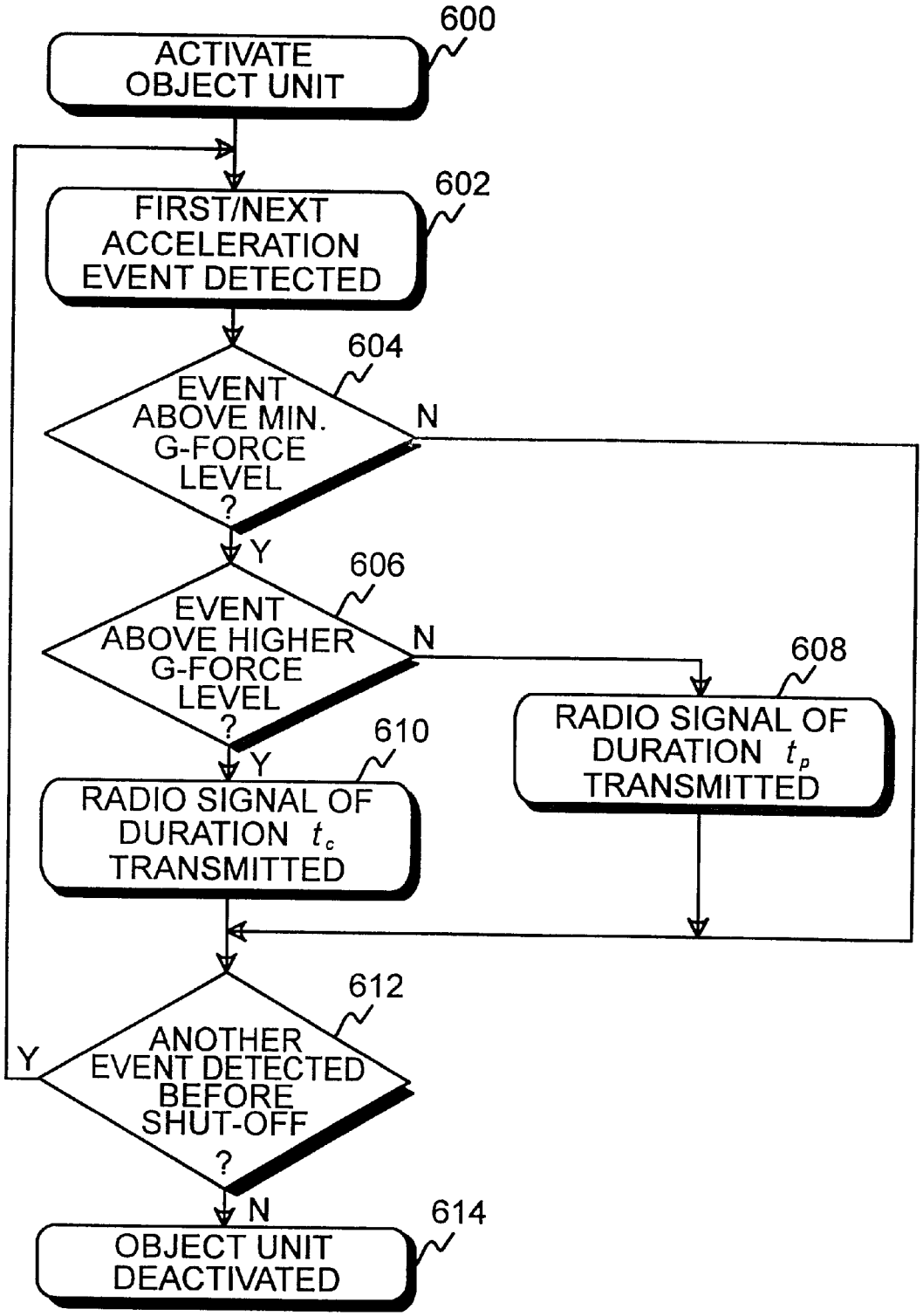
FIG. 6 shows a block diagram of a non-modulated radio transmission with a dual threshold level by the object unit.

FIG. 6 shows a block diagram of another embodiment of the invention that employs a non-modulated radio transmission with a dual threshold level by object unit 100. This embodiment of the invention is similar to that shown in FIGS. 3 through 6 but has the added feature that object unit 100 is able to detect two different g-force peaks and is able to signal to monitor unit 108 whether the lower or the upper threshold was hit. For a baseball, for example, the lower threshold is hit whenever a pitch occurs. The upper threshold is hit when a catch occurs. Catches result in greater g-forces than pitches and the threshold detectors are set accordingly.

Referring now to FIG. 6, the description of blocks 600 and 602 is the same as shown in FIG. 3 in corresponding blocks 300 and 302.

In block 604, if the lower g-force level is not reached, control passes to block 612. If the lower g-force level is hit, then in block 606 the threshold circuitry tests to see if the acceleration event is above the predetermined higher g-force level. If yes, in block 610 a single non-modulated radio signal event marker with a duration of $t_c$ is transmitted and control passes to block 612. If the answer in block 606 is no, then a single non-modulated signal event marker of duration $t_p$ is transmitted and control passes to block 612. Duration $t_c$ is greater than duration $t_p$.

In block 612, if another acceleration event is detected before the predetermined shut-off time (typically one minute), then control returns to block 602. If not, control passes to block 614 where object unit 100 is deactivated through its shut-off circuitry.

Figure 7:
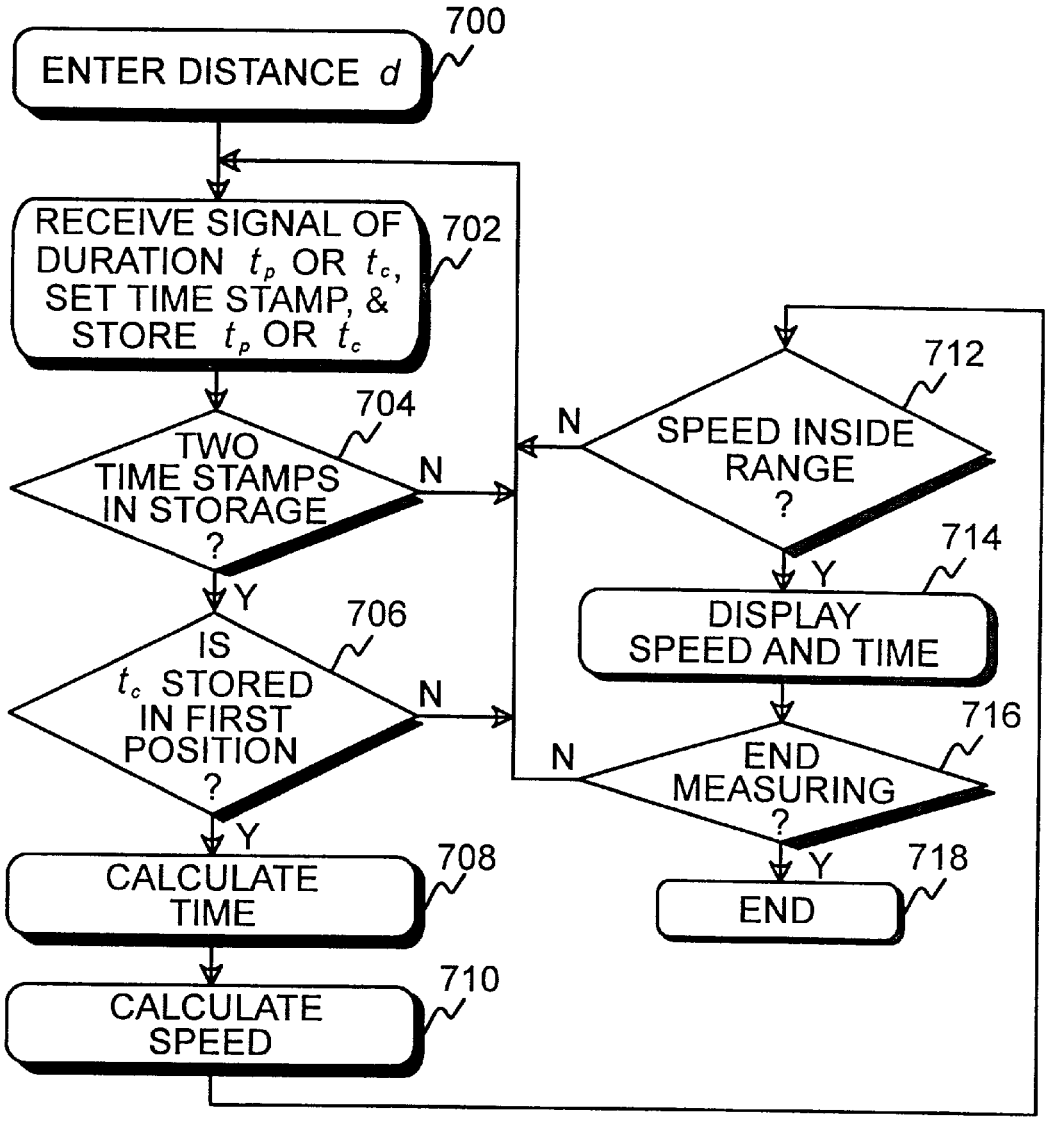
FIG. 7 shows a block diagram of a non-modulated radio transmission with a dual threshold level by the monitor unit.

FIG. 7 shows a block diagram of another embodiment of the invention that employs a non-modulated radio transmission with a dual threshold level by monitor unit 108. Referring now to FIG. 7, in block 700 the user enters through numeric keypad 202 (FIG. 2) the distance d between two points where characteristics of the object containing object unit 100 (FIG. 1) are desired to be measured.

In block 702 radio receiver 110 (FIG. 1) receives a radio signal event marker sent from radio transmitter 106 from FIG. 6. Monitor unit 108 can distinguish between the two signal durations $t_p$ and $t_c$ that are sent. A time stamp is set and stored, along with either $t_p$ or $t_c$, in a first position upon receiving a signal event marker.

In block 704 a check is made to determine if there are two time stamps in storage. If not, control returns to block 702. If two time stamps are in storage, control passes to block 706 which determines whether the first position has a stored duration of $t_c$. If the answer is no, control returns to block

702. If the answer is yes, then in block 708 the time stamp stored in the second position is subtracted from the time stamp stored in the first position to determine the time of flight of the projectile. Then in block 710 the distance d from block 700 is divided by the time of flight from block 708 to determine the speed of the projectile. In block 712 a check is made to determine if the speed falls inside a predetermined range, such as 60–100 MPH for a baseball pitch. If not, control returns to block 702 to receive the next signal event marker. If yes, block 714 displays the time of flight in time display 206 (FIG. 2) and the speed in speed display 208 (FIG. 2). Control then passes to block 716 to determine if measuring is to end. If not, control passes to block 702. If yes, block 718 ends the operation of the invention.

Figure 8:
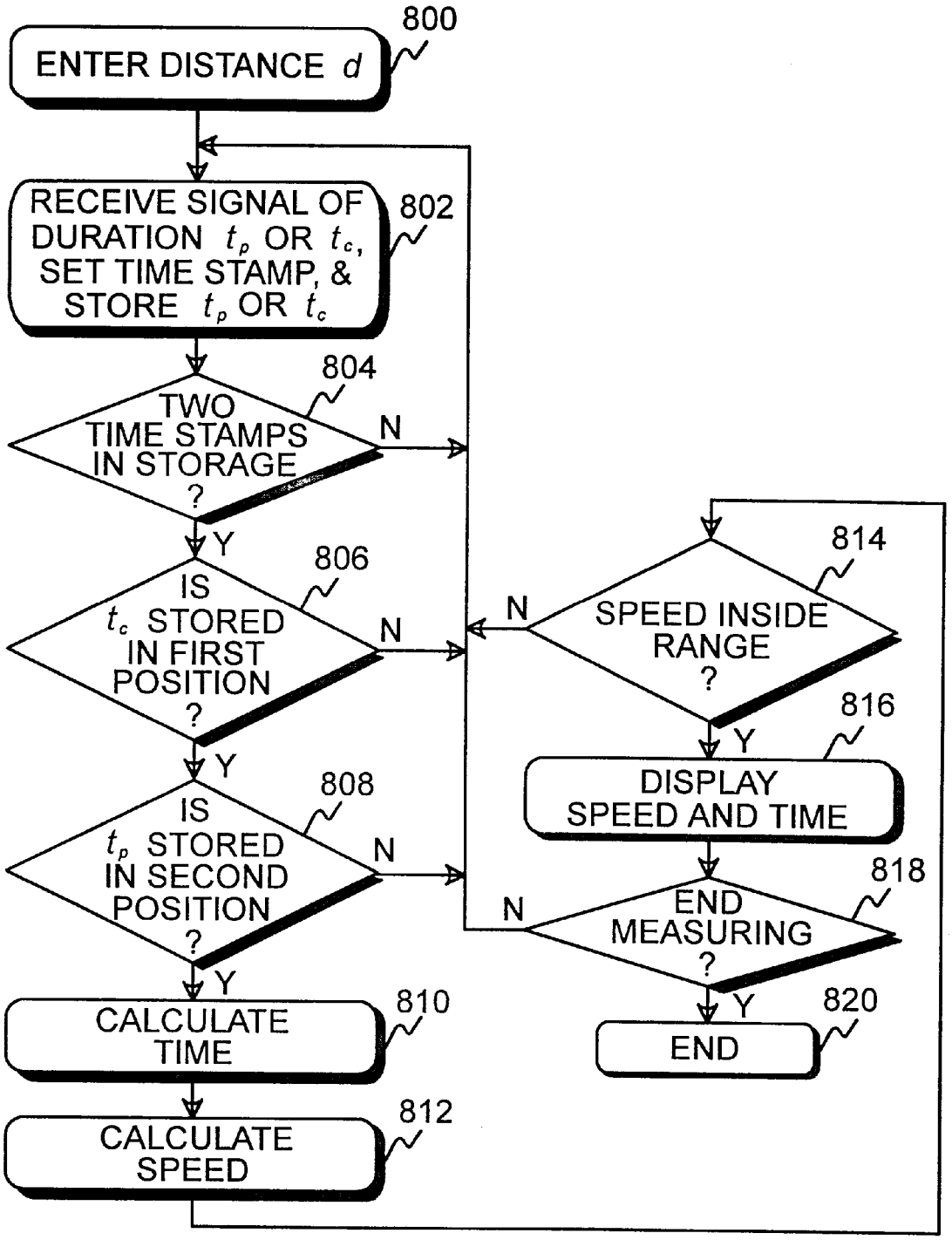
FIG. 8 shows a block diagram of another embodiment of a non-modulated radio transmission with a dual threshold level by the monitor unit.

FIG. 8 shows a block diagram of another embodiment of a non-modulated radio transmission with a dual threshold level by monitor unit 108. It is possible to provide further automated filtering of irrelevant acceleration events by requiring that a signal of duration $t_c$ be preceded by a signal of duration $t_p$. In other words, when a signal of duration $t_c$ is received, and the resulting speed calculation is within the predetermined range, the display is still not updated if the previous received signal was also of duration $t_c$. Referring now to FIG. 8, the description of blocks 800 through 804 is the same as shown in FIG. 7 in corresponding blocks 700 through 704.

Block 806 determines whether the first position has a stored duration of $t_c$. If not, control returns to block 802. If the answer is yes, then block 808 determines if the second position has a stored duration of $t_p$. If not, control returns to block 802. If the answer is yes, then control passes to block 810. The description of blocks 810 through 820 is the same as shown in FIG. 7 in corresponding blocks 708 through 718.

FIGS. 9 through 13 show an embodiment of the invention that is similar to that in FIGS. 6 through 8 except that the object unit has the ability to transmit a radio frequency signal whose duration is proportional to the maximum g-force attained in an acceleration event, or alternatively, the object unit's radio transmission is modulated with a data signal that is representative of the maximum g-force attained in an acceleration event.

The modulation strategy addresses the interference issue that arises when multiple numbers of the invention are used in the same vicinity by modulating the data emanating from the object unit with an identification code. The monitor unit packaged with the object unit is factory preset to recognize its mate by way of this identification code as well as the selected frequency. A monitor unit may 'hear' many different signals in an environment crowded with similar object units but will accept only the signals marked with the identification code of its mate. In this strategy, interference is limited to the garbling of transmitted data that occurs if two projectiles transmit event markers simultaneously on the same frequency. A monitor unit that uses an identification code would normally be factory preset to work with a specific projectile that is factory preset to the same identification code. However, a monitor unit designed to allow the user to program the projectile identification code of interest could be used with different projectiles. That is, one monitor unit could simultaneously display trajectory statistics for a multiplicity of object units and the object units could be used simultaneously. However, if acceleration events for two or more object units occur at the same instant and result in the transmission of the event markers at the same instant at the same frequency, the system will not work. The probability of this occurring is a function of the number of projectiles being monitored on the same frequency, the frequency of acceleration events per object unit, and the duration of each event marker transmission.

For a pitcher/catcher pair tossing a ball back and forth, as many as four event markers are transmitted per pitch. If they average 20 seconds total round trip per pitch, and each acceleration event results in a 10 bit identification code transmission at 2400 bits per second, the total percentage of time in which there is an event marker transmission is 8.3%. The percentage of time in which there is transmission of data of interest (the pitcher's pitch vs. the catcher's toss) is 4.15%. For a few pitcher/catcher pairs, this would not be a big problem, but some collisions would occur and would result in lost or invalid data. If there were 100 pitcher/catcher pairs within the reception range of a monitor the devices would be useless.

Regarding the proportional duration transmission alternative, all acceleration events resulting in g-forces above a built-in minimum value will result in the transmission of an event marker to the monitor unit. The monitor unit derives the g-force level attained from the duration of the received signal. For example, a transmission of 30 milliseconds might correspond to 300 Gs whereas a 100 millisecond transmission might correspond to 1000 Gs. Flight time is measured as the time from the beginning of one received signal to the beginning of the next received signal.

Regarding the modulated transmission alternative, all acceleration events resulting in g-forces above a built-in minimum threshold will result in the transmission of a modulated signal to the monitor unit. Flight time is measured by the monitor unit as the time from the reception of one event marker to the next. A datum received in the transmission indicates the g-force attained and is used by the monitor unit to decide whether a pitch or a catch has occurred. All of the filtering techniques described in FIGS. 9 through 13 apply whether digital data is sent that represents the g-force attained or a proportional duration signal is transmitted.

Figure 9:
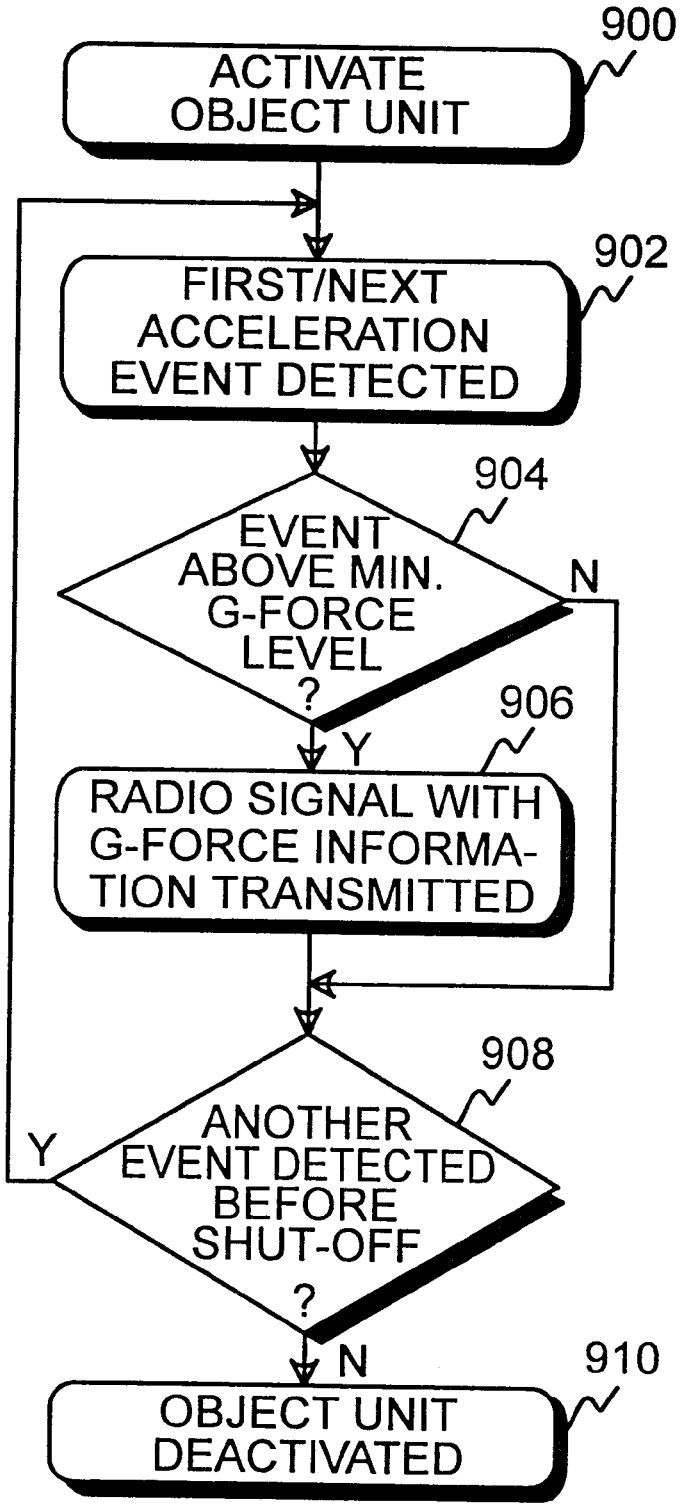
FIG. 9 shows a block diagram of a g-force proportional duration or modulated data transmission by the object unit.

FIG. 9 shows a block diagram of an embodiment of the invention that employs a g-force proportional duration or modulated data transmission by object unit 100. Referring now to FIG. 9, the description of blocks 900 and 902 is the same as shown in FIG. 6 in corresponding blocks 600 and 602. In block 904, if the minimum g-force level is not reached, control passes to block 908. If the minimum g-force level is reached, then in block 906 a radio signal that carries g-force information, either proportional duration or modulated, is transmitted. The description of blocks 908 and 910 is the same as shown in FIG. 6 in corresponding blocks 612 and 614.

Figure 10:
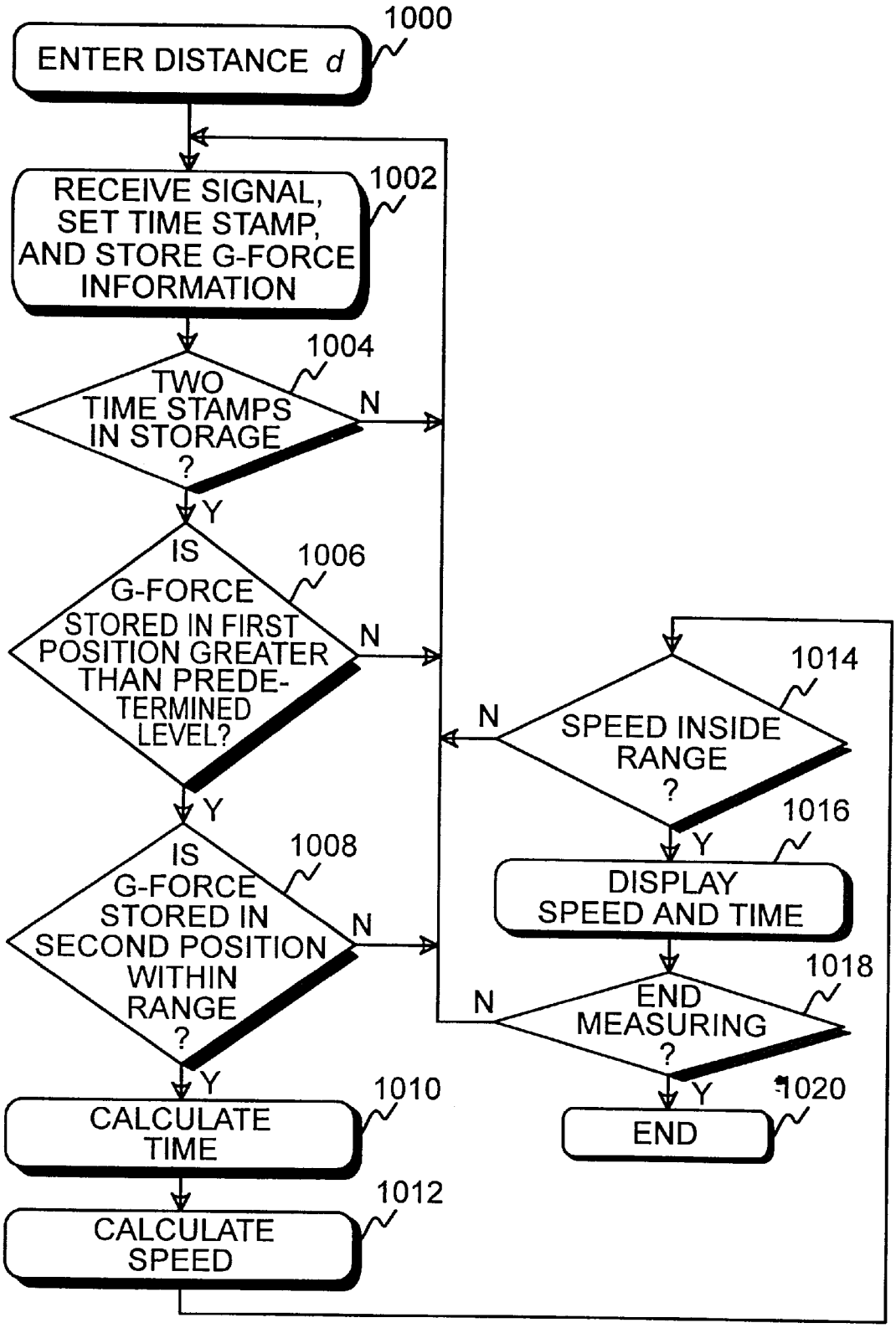
FIG. 10 shows a block diagram of a g-force proportional duration or modulated data transmission by the monitor unit.

FIG. 10 shows an embodiment of the invention that employs a g-force proportional duration or modulated data transmission by monitor unit 108. Monitor unit 108 is programmed to update the speed display only after receiving a proportional duration transmission greater than a predetermined time, such as 60 milliseconds, that is preceded by a proportional duration transmission between a predetermined range, such as 10 to 20 milliseconds, provided that the resulting speed based on the two transmissions is between a predetermined range, such as 30 to 100 MPH. For modulated data transmission, monitor unit 108 is programmed to update the speed display only after receiving a modulated data transmission of a g-force greater than a predetermined minimum that is preceded by a modulated data transmission of a g-force between a predetermined g-force range, provided that the resulting speed based on the two transmissions is between a predetermined range, such as 30 to 100 MPH.

Referring now to FIG. 10, in block 1000 the user enters through numeric keypad 202 (FIG. 2) the distance d between two points where characteristics of an object containing object unit 100 (FIG. 1) are desired to be measured.

In block 1002 radio receiver 110 (FIG. 1) receives the radio signal event marker sent from radio transmitter 106 from FIG. 9, sets a time stamp, and stores g-force information, either proportional duration or modulated. In block 1004 a check is made to determine if there are two time stamps in storage. If not, control returns to block 1002. If two time stamps are in storage, control passes to block 1006 which determines if the time stamp stored in the first position has a g-force greater than a predetermined level, corresponding to a catch event. If not, control returns to block 1002. If yes, then block 1008 determines if the time stamp stored in the second position has a g-force that falls within a predetermined range, corresponding to a pitch event range. If not, control returns to block 1002. If yes, control passes to block 1010. The description of blocks 1010 through 1020 is the same as shown in FIG. 7 in corresponding blocks 708 through 718.

Figure 11:
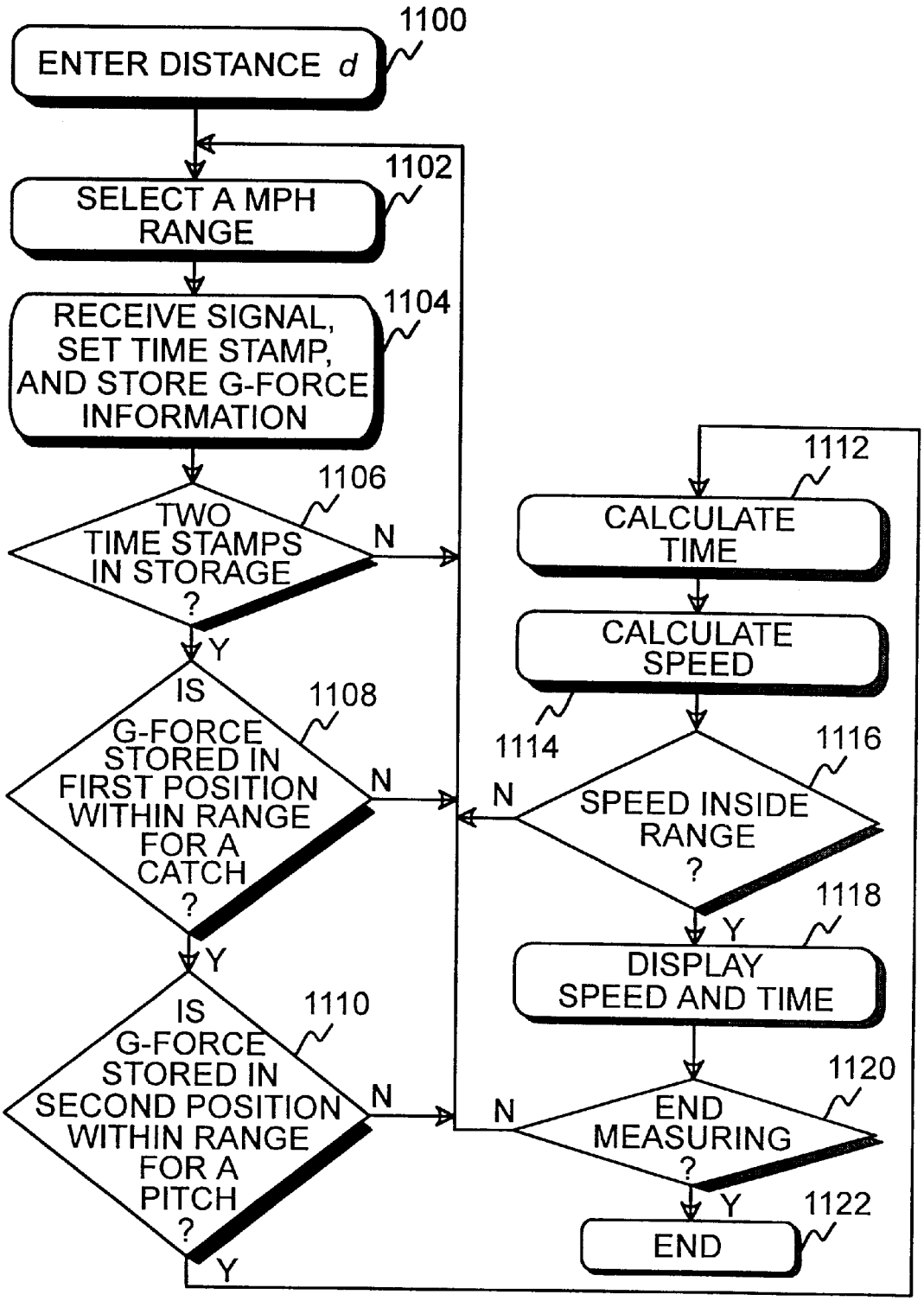
FIG. 11 shows a block diagram of a g-force proportional duration or modulated data transmission by the monitor unit with user selectable speed range measuring.

FIG. 11 shows a block diagram of an embodiment of the invention that employs a g-force proportional duration or modulated data transmission by monitor unit 108 with user selectable speed range or other statistic measuring. For a baseball, for example, the user can tune the g-force threshold to his/her pitching speed by selecting the speed range in which the user believes their pitches fall. For example, face 200 of monitor unit 108 may have buttons labeled 40–50 MPH, 50–60 MPH, 60–70 MPH, 70–80 MPH, 80–90 MPH, and 90–100 MPH (not shown in FIG. 2). When the user selects one of the speed ranges, the monitor unit uses a preprogrammed lookup table for the range of g-forces generated in pitches and catches within the selected pitch speed range. This provides an additional filtering capability for discarding event markers that are unrelated to the pitches being measured.

As an example, suppose that the user has pressed a 60–70 MPH button, thus selecting this pitch speed range. Corresponding to this selection, the receiving unit's lookup table might indicate that the unit should interpret events generating 30 to 60 Gs as pitches and events generating 600 to 1500 Gs as catches. The unit would then update the speed display only upon receiving a 30 to 60 G event marker followed by a 600 to 1500 G event marker that results in a reasonable calculated speed, such as between 50 to 80 MPH.

Referring now to FIG. 11, in block 1100 the user enters through numeric keypad 202 (FIG. 2) the distance d between two points where characteristics of an object containing object unit 100 (FIG. 1) are desired to be measured.

In block 1102 the user selects a MPH range for monitoring pitches by pressing a button on the monitor unit. A lookup table establishes a g-force range for pitches and a g-force range for catches corresponding to the MPH range selected.

The description of blocks 1104 and 1106 is the same as shown in FIG. 10 in corresponding blocks 1002 and 1004. Block 1108 determines if the time stamp stored in the first position has a g-force that falls within the preselected range for a catch. If not, then control returns to block 1102. If yes, then block 1110 determines if the time stamp stored in the second position has a g-force that falls within the preselected range for a pitch. If not, control returns to block 1102. If yes, control passes to block 1112. The description of blocks 1112 through 1122 is the same as shown in FIG. 7 in corresponding blocks 708 through 718.

Figure 12:
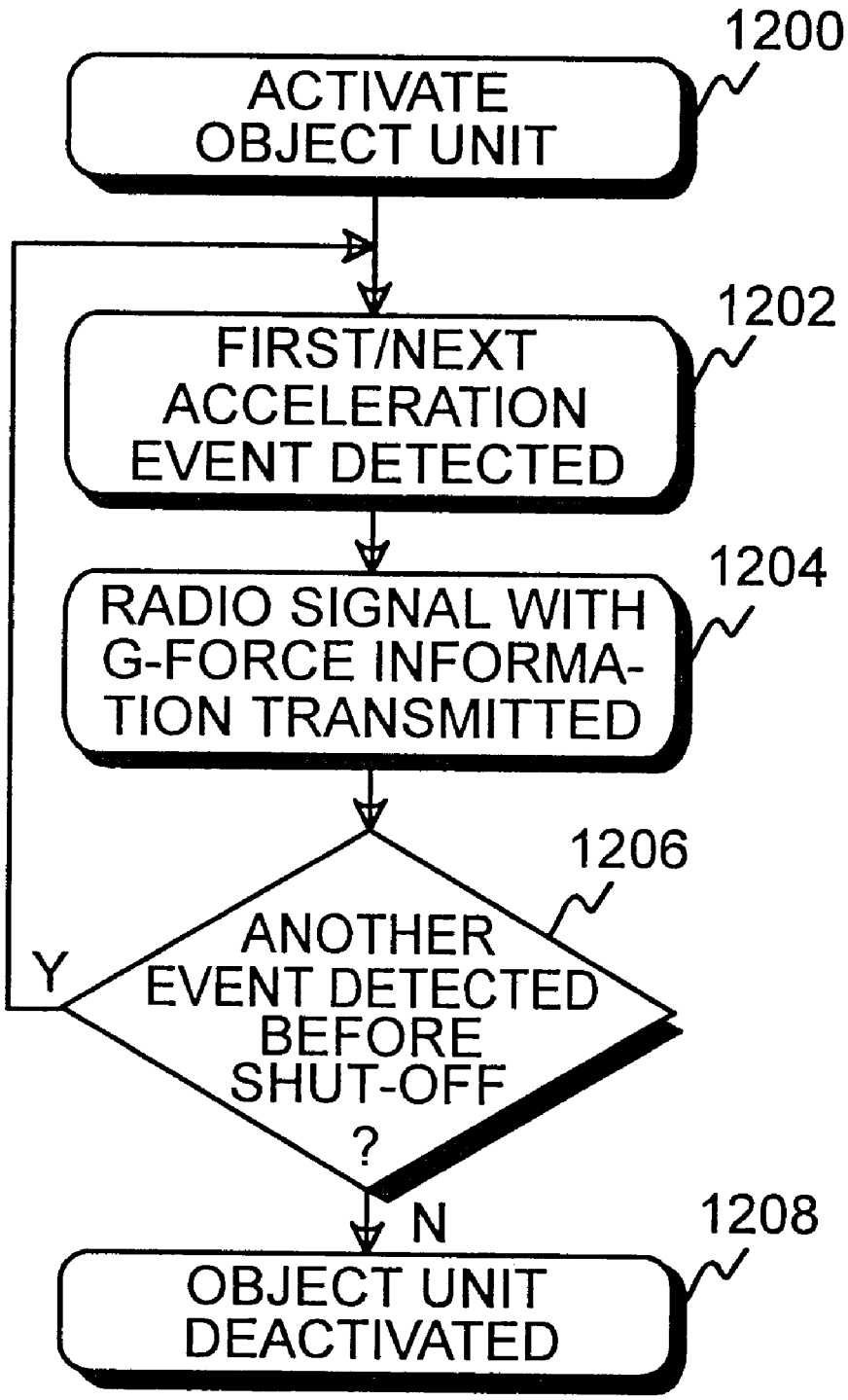
FIG. 12 shows a block diagram of a g-force proportional duration or modulated data transmission by the object unit with catch/pitch g-force ratio measuring.

FIG. 12 shows a block diagram of an embodiment of the invention that employs a g-force proportional duration or modulated data transmission operation by object unit 100 with catch/pitch g-force ratio measuring. This filtering technique uses g-force proportional duration or modulated data event marker indications. The speed display is updated only after receiving an event marker indicative of a catch (that is, it exceeds some minimum value such as 1000 Gs) that is preceded by an event marker indicating a lesser g-force (possibly a pitch), such that the ratio of the catch g-force to the previous g-force is within a predetermined range.

Referring now to FIG. 12, the description of blocks 1200 and 1202 is the same as shown in FIG. 6 in corresponding blocks 600 and 602. In block 1204 a radio signal that carries g-force information, either proportional duration or modulated, is transmitted. The description of blocks 1206 and 1208 is the same as shown in FIG. 6 in corresponding blocks 612 and 614.

Figure 13:
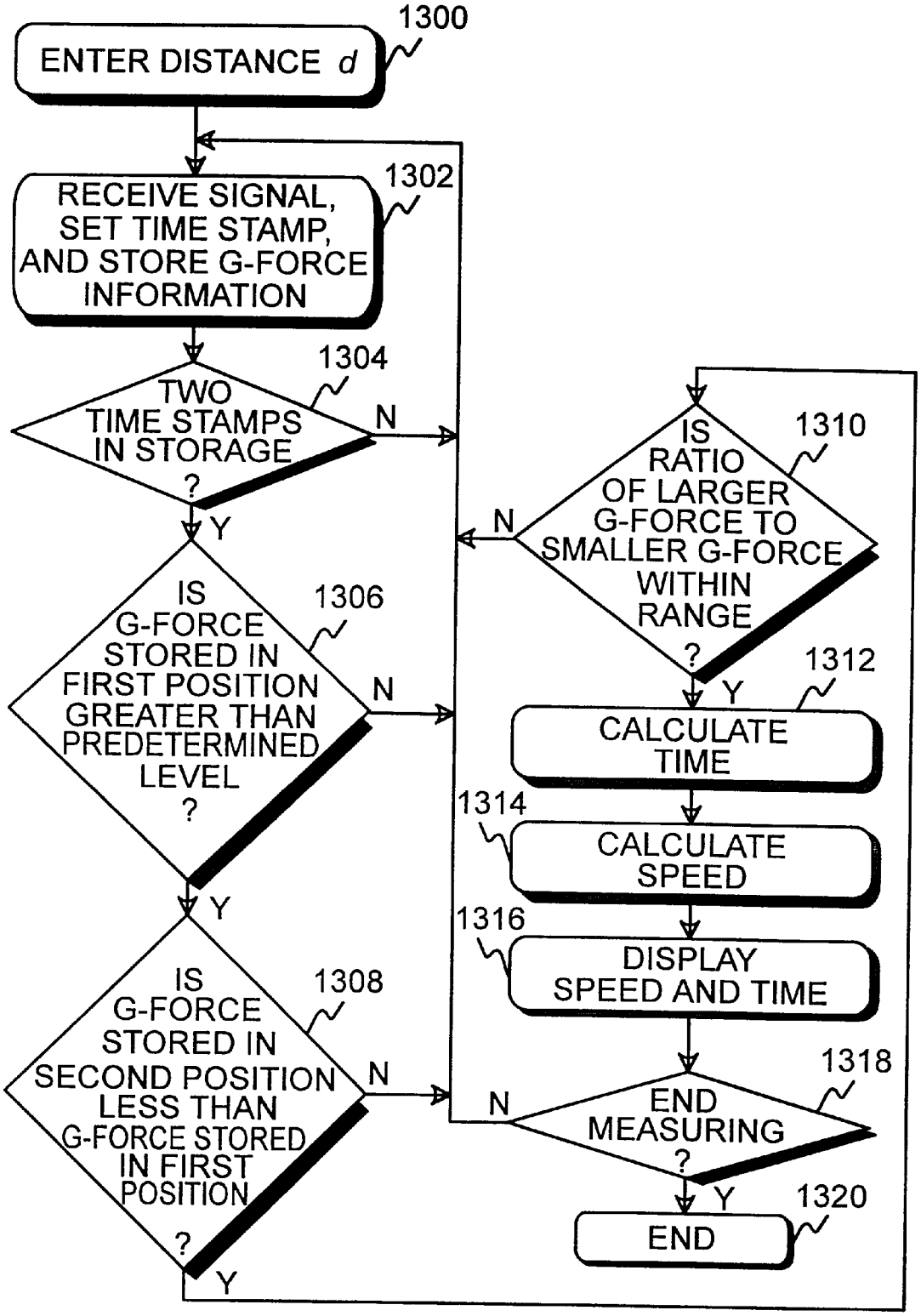
FIG. 13 shows a block diagram of a g-force proportional duration or modulated data transmission by the monitor unit with catch/pitch g-force ratio measuring.

FIG. 13 shows a block diagram of an embodiment of the invention that employs a g-force proportional duration or modulated data transmission by monitor unit 108 with catch/pitch g-force ratio measuring. Referring now to FIG. 13, in block 1300 the user enters through numeric keypad 202 (FIG. 2) the distance d between two points where characteristics of an object containing object unit 100 (FIG. 1) are desired to be measured.

In block 1302 radio receiver 110 (FIG. 1) receives the radio signal event marker sent from radio transmitter 106 from FIG. 12, sets a time stamp, and stores g-force information, either proportional duration or modulated. In block 1304 a check is made to determine if there are two time stamps in storage. If not, control returns to block 1302. If two time stamps are in storage, control passes to block 1306 which determines if the time stamp stored in the first position has a g-force that falls above a predetermined minimum level. If not, control returns to block 1302. If yes, then block 1308 determines if the time stamp stored in the second position has a smaller g-force than that stored in the first position. If not, control returns to block 1302. If yes, block 1310 determines if the ratio of the larger g-force to the smaller g-force falls within a predetermined range. If not, control returns to block 1302. If yes, control passes to block 1312.

In block 1312 the time stamp stored in the second position is subtracted from the time stamp stored in the first position to determine the time of flight of the projectile. Then in block 1314 the distance d from block 1300 is divided by the time of flight from block 1312 to determine the speed of the projectile. Block 1314 displays the time of flight in time display 206 (FIG. 2) and speed in speed display 208 (FIG. 2). Control then passes to block 1318 to determine if measuring is to end. If not, control returns to block 1302. If yes, block 1320 ends the operation of the invention.

Figure 14:
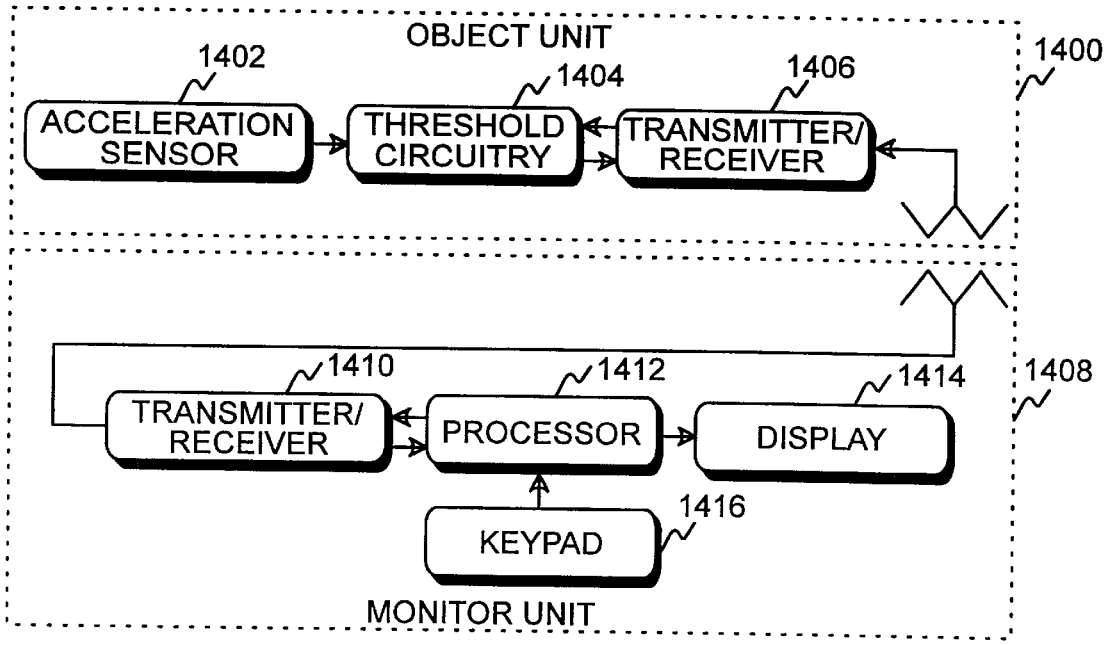
FIG. 14 shows a block diagram of another embodiment of a device for measuring the time of motion, speed, and trajectory height of a projectile.

FIG. 14 shows a block diagram of another embodiment of a device for measuring the time of motion, speed, and trajectory height of an object. Referring now to FIG. 14, the description of the elements 1400 through 1416 is the same as shown in FIG. 1 in corresponding elements 100 to 116 except for transmitter 106 and receiver 110. In this embodiment, object unit 1400 has transmitter/receiver 1406 and monitor unit has transmitter/receiver 1410. In this embodiment, it is possible for monitor unit 1408 to transmit to object unit 1400 the event threshold levels appropriate to the projectile in use and the user. In this embodiment, object unit 1400 does not need to transmit g-force proportional signals or modulating data signals. The internal electronics of object unit 1400 sets the event threshold levels as directed by monitor unit 1408. Acceleration events are signaled to monitor unit 1408 by radio transmissions. One skilled in the art will recognize that the single threshold operation described in FIGS. 3 through 5, or the dual threshold operation described in FIGS. 6 through 8, are applicable to this embodiment of the invention. Alternatively, the radio transmission from object unit 1400 could be modulated with data that indicates to monitor unit 1408 which event threshold was crossed.

Figure 15:
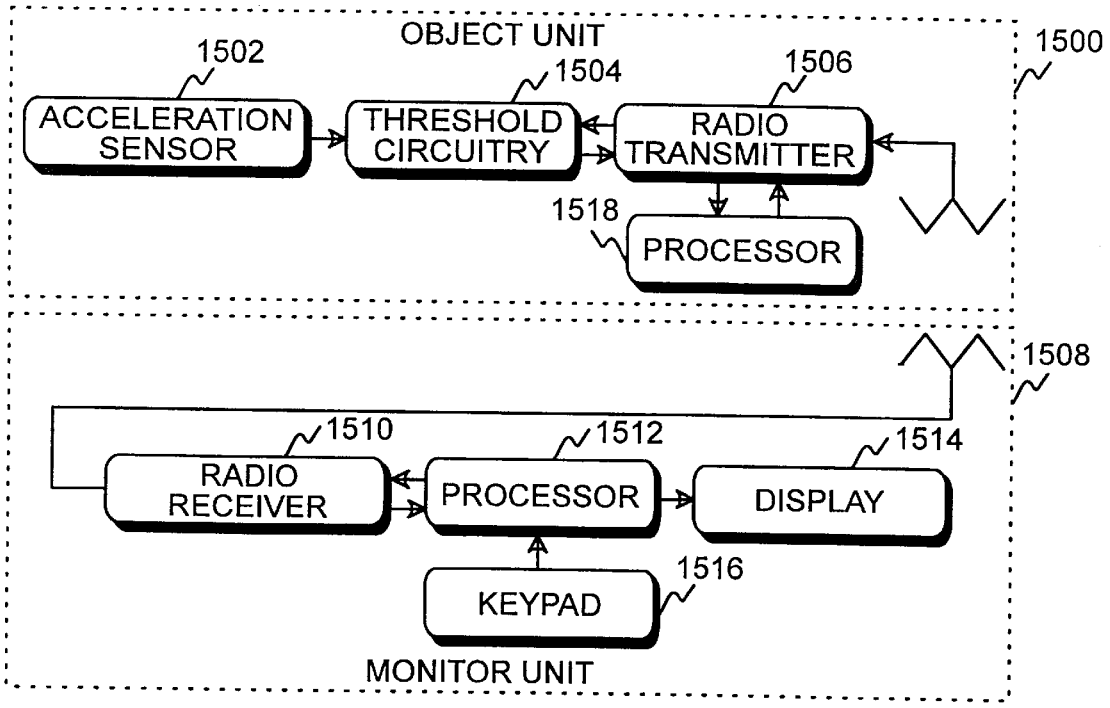
FIG. 15 shows a block diagram of yet another embodiment of a device for measuring the time of motion, speed, and trajectory height of a projectile.

FIG. 15 shows a block diagram of yet another embodiment of a device for measuring the time of motion, speed, and trajectory height of an object. Referring now to FIG. 15, the description of the elements 1500 through 1516 is the same as shown in FIG. 1 in corresponding elements 100 through 116. In addition, object unit 1500 has object unit processor 1518 that communicates with radio transmitter 1506.

In the embodiments above, the time between the starting and ending acceleration events is measured by the monitor unit. This requires the transmission of acceleration event markers for both the starting and ending events. In this embodiment, object unit 1500 transmits only the elapsed time between the starting and ending events. Object unit 1500 transmits the elapsed time only if a trajectory of relevance is detected. A relevant trajectory is defined by the application. The advantage of this embodiment is that many fewer transmissions will occur between object unit 1500 and monitor unit 1508. This is true for the baseball application because the low g-force threshold for a typical pitch starting event will be exceeded frequently in normal handling of a baseball. For the example of a baseball pitch, the object unit would perform the following algorithm to decide whether to transmit the elapsed time:

If an acceleration event of magnitude indicative of a catch occurred, and, the catch acceleration event was preceded by an acceleration event that is indicative of a pitch, and, the time elapsed between the pitch event and the catch event is reasonable as the time of flight of a pitched baseball, then, transmit the elapsed time to monitor unit 1508.

One skilled in the art will recognize that the flow of the above algorithm is similar to the flow of FIG. 8 except that the steps of the algorithm are performed by the object unit instead of the monitor unit. The elapsed time is transmitted to monitor unit 1508 using either a non-modulated radio signal whose duration is proportional to the elapsed time, or a radio signal modulated with the elapsed time information.

The power requirements for the object unit could be less in this embodiment for certain applications. For example, with a baseball pitch, the object unit would detect the pitch and catch events, evaluate them according to the above algorithm, and transmit the elapsed time to the monitor unit if the criteria are met. If the catcher is wearing the monitor unit, and he has caught the baseball, the power required to transmit the signal from the object unit to the monitor unit over a distance of only a few feet or inches would be small.

The filtering strategies discussed above in FIGS. 3 through 13 are based upon the use of peak g-force measurements or indications. This may apply well to certain applications such as detecting football punts or hockey puck slap shots, but for a baseball application, the g-forces experienced by the ball during a pitch (the actual movement of the ball in the pitcher's hand) are relatively low. A g-force threshold level that is set low enough to be indicative of a pitch is readily exceeded by incidental movement of the baseball. However, in a baseball pitch this low threshold g-force level will occur over a relatively long period of time when compared to threshold excursions occurring in the handling or bouncing of a ball and when compared to the impact of a kicking event, slap shot event, or catching event. This characteristic of pitches can be used in filtering out acceleration events that are not of interest for the baseball application. In this embodiment, all low g-force threshold indications (those less than the upper level threshold) are ignored if they persist for less than 50 milliseconds, for example. A typical pitch will exceed a 10 G threshold for 50 milliseconds, while a dropped ball hitting the ground will exceed 10 G for less than 10 milliseconds.

An object unit using this characteristic to help identify valid pitching events would not transmit an event marker upon detecting an acceleration below the threshold established for detecting catch events (the upper g-force level threshold) unless two conditions are met:

1. The g-force detected was above the preset minimum g-force threshold level.
2. The threshold excursion persisted for a preset minimum interval.

If these conditions are met, the object unit would transmit an event marker using any one of the embodiments previously described:

a fixed duration non-modulated radio transmission (FIGS. 3 through 5);

a lower threshold non-modulated radio transmission that is fixed in duration but differs in duration from that transmitted when the upper threshold is crossed (FIGS. 6 through 8);

a non-modulated radio transmission whose duration is proportional to the peak g-force attained in the acceleration event (FIGS. 9 through 13); and a modulated radio transmission that carries a peak g-force datum (FIGS. 9 through 13).

The projectile could also transmit an event marker that carries an additional piece of information, the duration of the threshold excursion:

a modulated radio transmission that carries a peak g-force datum and a datum representing the length of the interval over which the lower threshold excursion persisted.

An object unit with the internal filtering and timing capability described in FIG. 15 can also use this characteristic to filter out incidental acceleration events not related to pitching a baseball. The object unit would perform the following algorithm to decide whether to transmit the elapsed time:

If an acceleration event of magnitude indicative of a catch occurred, that is, the high threshold (400 Gs, for example) was exceeded, and the catch acceleration event was preceded by an acceleration event that is indicative of a pitch, that is, the lower g-force threshold (5 Gs, for example) was exceeded for a period of time (50 milliseconds, for example) or greater, and the time elapsed between the pitch event and the catch event is reasonable as the time of flight of a pitched baseball (it falls between 500 and 1500 milliseconds, for example), then the projectile will transmit the elapsed time to the monitor.

One skilled in the art will recognize that the flow of the above algorithm is similar to the flow of FIG. 8 except that the steps of the algorithm are performed by the object unit instead of the monitor unit.

Having described a presently preferred embodiment of the present invention, it will be understood by those skilled in the art that many changes in construction and circuitry and widely differing embodiments and applications of the invention will suggest themselves without departing from the scope of the present invention, as defined in the claims. The disclosures and the description herein are intended to be illustrative and are not in any sense limiting of the invention, defined in scope by the following claims.

What is claimed is:

1. A measuring device comprising:

(a) an object unit secured to a movable object, said object unit comprising (a1) an acceleration sensor that detects an acceleration event of said movable object, (a2) a threshold circuit connected to said acceleration sensor, and (a3) a first radio transmitter connected to said threshold circuit; and (b) a monitor unit external to said object unit comprising (b1) a first radio receiver wherein said object unit communicates with said monitor unit by sending from said radio transmitter at least one radio signal to said first radio receiver, (b2) a first processor connected to said first radio receiver, wherein said first processor determines motion characteristics of said movable object, (b3) an output display connected to said first processor, and (b4) an input keypad connected to said first processor.

2. A measuring device according to claim 1 wherein said object unit is embedded, secured, or attached within a solid movable object of varying densities.

3. A measuring device according to claim 1 wherein said object unit is embedded, secured, or attached within a hollow deformable movable object.

4. A measuring device according to claim 1 wherein said object unit is embedded, secured, or attached within a uniformly solid movable object.

5. A measuring device according to claim 1 wherein said object unit is embedded, secured, or attached within a hollow rigid movable object.

6. A measuring device according to claim 1 wherein said acceleration sensor is an accelerometer selected from the group consisting of piezoelectric, mechanical, and micromachined silicon chip.

7. A measuring device according to claim 1 wherein said acceleration sensor can detect said acceleration event of said movable object along at least one axis.

8. A measuring device according to claim 1 wherein internal power to activate said object unit is activated by motion, wherein said object unit stays activated for a predetermined period of time and is deactivated thereafter unless subsequent motion occurs within said predetermined period of time, wherein said object unit stays activated for another said predetermined period of time.

9. A measuring device according to claim 1 wherein said at least one radio signal is non-modulated.

10. A measuring device according to claim 9 wherein said at least one non-modulated radio signal is of a fixed duration.

11. A measuring device according to claim 10 wherein said first radio transmitter sends at least one non-modulated radio signal of a different fixed duration to said first radio receiver.

12. A measuring device according to claim 9 wherein said object unit further comprises a second processor connected to said first radio transmitter wherein the elapsed time between a starting point and an ending point of said acceleration event is calculated by said second processor and transmitted by said first radio transmitter to said first radio receiver in said monitor unit as said at least one non-modulated radio signal having a duration proportional to said elapsed time.

13. A measuring device according to claim 1 wherein said motion characteristics measured include an elapsed time and a speed.

14. A measuring device according to claim 1 wherein said motion characteristics measured include a distance and a trajectory height.

15. A measuring device according to claim 1 wherein said first radio transmitter sends to said first radio receiver at least one modulated radio signal having a transmission duration proportional to the g-force of said acceleration event.

16. A measuring device according to claim 15 wherein said at least one modulated radio signal further comprises an identification code derived from said object unit wherein said monitor unit will only process said modulated radio signal when said identification code is recognized by said monitor unit.

17. A measuring device according to claim 16 wherein said monitor unit monitors a plurality of movable objects, each of said plurality of movable objects containing a said object unit, each of said object units having a unique code within said identification code.

18. A measuring device according to claim 1 wherein said first radio transmitter sends to said first radio receiver at least one modulated radio signal having a datum of the g-force of said acceleration event.

19. A measuring device according to claim 18 wherein said at least one modulated radio signal further comprises an identification code derived from said object unit wherein said monitor unit will only process said modulated radio signal when said identification code is recognized by said monitor unit.

20. A measuring device according to claim 19 wherein said monitor unit monitors a plurality of movable objects, each of said plurality of movable objects containing a said object unit, each of said object units having a unique code within said identification code.

21. A measuring device according to claim 18 wherein said object unit further comprises a second processor connected to said radio transmitter wherein the elapsed time between a starting point and an ending point of said acceleration event is calculated by said second processor and transmitted by said radio transmitter as a datum in said at least one modulated radio signal to said first radio receiver in said monitor unit.

22. A measuring device according to claim 1 wherein said object unit further comprises a second radio receiver connected to said threshold circuit and said monitor unit further comprises a second radio transmitter connected to said first processor, wherein said monitor unit communicates with said object unit through said second radio transmitter and said second radio receiver, and further wherein portions of said object unit may be activated and deactivated by signals sent from said second radio transmitter to said second radio receiver.

23. A measuring device according to claim 1 wherein said monitor unit further comprises an ultrasonic wave transmitter and receiver wherein the distance between the two points over which said movable object is to be measured can be determined by transmitting an ultrasonic wave from said ultrasonic wave transmitter and receiver located at one of said two points to the other of said two points, wherein said ultrasonic wave is reflected from said other of said two points back to said ultrasonic wave transmitter and receiver.

24. A method for measuring a movable object comprising the following steps:

(a) receiving a distance between two points wherein motion characteristics of a movable object moving between said two points are desired to be measured;

(b) detecting a first acceleration event of said movable object utilizing an acceleration sensor secured to said movable object;

(c) determining a first time for said first acceleration event;

(d) detecting a second acceleration event of said movable object utilizing said acceleration sensor secured to said movable object;

(e) determining a second time for said second acceleration event;

(f) subtracting said first time from said second time to determine the elapsed time; and (g) calculating the speed of said movable object by dividing said distance by said elapsed time.

25. A method for measuring a movable object according to claim 24 wherein step (a) further comprises the following step (a1), step (b) further comprises the following step (b1), step (c) further comprises the following steps (c1), (c2), (c3), and (c4), step (e) further comprises the following step (e1), and step (f) further comprise the following step (f1):

(a1) entering said distance between said two points through an input keypad of a monitor unit, wherein said distance is stored in a first processor within said monitor unit connected to said input keypad;

(b1) locating said acceleration sensor within an object unit wherein said object unit is secured to said movable object, and further wherein said monitor unit is located external to said object unit;

(c1) determining said first time for said first acceleration event by stimulating a first radio transmitter within said object unit to transmit a radio signal upon detection of said first acceleration event;

(c2) receiving said transmitted radio signal in a first radio receiver located in said monitor unit;

(c3) setting a first time stamp for said received transmitted radio signal;

(c4) storing said first time stamp in a first position in said first processor connected to said first radio receiver;

(e1) determining said second time for said second acceleration event by repeating steps (c1) through (c4) for said second acceleration event of said movable object, wherein said first time stamp is moved to a second position in said first processor and a second time stamp is set for said second acceleration event and is stored in said first position in said first processor; and (f1) determining said elapsed time by subtracting said first time stamp stored in said second position from said second time stamp stored in said first position.

26. A method for measuring a movable object according to claim 25 wherein step (c1) further comprises the steps of:

(c1a) testing said first acceleration event with a threshold circuit connected to said acceleration sensor to determine if said first acceleration event is above a predetermined minimum g-force level; and (c1b) stimulating said first radio transmitter connected to said threshold circuit to transmit said radio signal when said first acceleration event is above said predetermined minimum g-force level.

27. A method for measuring a movable object according to claim 26 wherein step (c1b) further comprises the following step (c1b1), step (c4) further comprises the following step (c4a), step (e1) further comprises the following step (e1a), and step (f1) further comprises the following step (f1a):

(c1b1) when said first acceleration event is above said predetermined minimum g-force level, stimulating said first radio transmitter connected to said threshold circuit to transmit a non-modulated radio signal of a first duration when said first acceleration event is also above a predetermined higher g-force level, and when not above said predetermined higher g-force level, transmitting a non-modulated radio signal of a second duration, wherein said first duration is longer than said second duration;

(c4a) storing said first time stamp and a first indicator for either said first duration or said second duration in said first position in said first processor connected to said first radio receiver;

(e1a) repeating steps (c1a) through (d) for said second acceleration event of said movable object, wherein said first time stamp and said first indicator are moved to said second position in said first processor and said second time stamp is set for said second acceleration event and a second indicator for either said first duration or said second duration is stored in said first position in said first processor; and (f1a) when said second indicator stored in said first position is of said first duration, subtracting said first time stamp stored in said second position from said second time stamp stored in said first position to determine said elapsed time between said first time stamp and said second time stamp.

28. A method for measuring a movable object according to claim 27 wherein step (f1a) further comprises the step of:

(f1a1) when said second indicator stored in said first position is of said first duration, and said first indicator stored in said second position is of said second duration, subtracting said first time stamp stored in said second position from said second time stamp stored in said first position to determine said elapsed time between said first time stamp and said second time stamp.

29. A method for measuring a movable object according to claim 26 wherein step (c1b) further comprises the following step (c1b1), step (c4) further comprises the following step (c4a), step (e1) further comprises the following step (e1a), and step (f1) further comprises the following step (f1a):

(c1b1) stimulating said first radio transmitter within said object unit connected to said threshold circuit to transmit a non-modulated radio signal whose duration is proportional to the maximum g-force of said first acceleration event when said first acceleration event is above said predetermined minimum g-force level;

(c4a) storing said first time stamp and a first indicator for said maximum g-force of said first acceleration event in said first position in said first processor connected to said first radio receiver;

(e1a) repeating steps (c1a) through (d) for said second acceleration event of said movable object, wherein said first time stamp and said first indicator are moved to a second position in said first processor and said second time stamp is set for said second acceleration event and a second indicator for said maximum g-force of said second acceleration event is stored in said first position in said first processor; and (f1a) when said second indicator stored in said first position is greater than a predetermined level, and said first indicator stored in said second position is within a predetermined range, subtracting said first time stamp stored in said second position from said second time stamp stored in said first position to determine said elapsed time between said first time stamp and said second time stamp.

30. A method for measuring a movable object according to claim 29 wherein step (a1) further comprises the following steps (a1a) and (a1b), and step (f1) further comprises the following step (f1a):

(a1a) storing a pre-programmed lookup table in said first processor which has a lower g-force range and an upper g-force range corresponding to at least one mile per hour range;

(a1b) selecting one of said at least one mile per hour range from said input keypad; and (f1a) when said second indicator stored in said first position is within said upper g-force range from said pre-programmed lookup table, and said first indicator stored in said second position is within said lower g-force range from said pre-programmed lookup table, subtracting said first time stamp stored in said second position from said second time stamp stored in said first position to determine said elapsed time between said first time stamp and said second time stamp.

31. A method for measuring a movable object according to claim 29 wherein step (f1a) further comprises the step of:

(f1a1) when said second indicator stored in said first position is greater than said predetermined level, and said first indicator stored in said second position is less than said second indicator, and the ratio of said first indicator stored in said second position to said second indicator stored in said first position is within a predetermined ratio range, subtracting said first time stamp stored in said second position from said second time stamp stored in said first position to determine said elapsed time between said first time stamp and said second time stamp.

32. A method for measuring a movable object according to claim 26 wherein step (c1b) further comprises the following step (c1b1), step (c2) further comprises the following step (c2a), and step (c3) further comprises the following step (c3a):

(c1b1) stimulating said first radio transmitter within said object unit connected to said threshold circuit to transmit a modulated radio signal that has an identification code and a datum of the maximum g-force of said acceleration event when said first acceleration event is above said predetermined minimum g-force level;

(c2a) receiving said transmitted modulated radio signal in said first radio receiver located in said monitor unit, external to said object unit, and programmed to accept said modulated radio signal having said identification code; and (c3a) setting a first time stamp for said received transmitted modulated radio signal.

33. A method for measuring a movable object according to claim 25 wherein step (c1) further comprises the steps of:

(c1a) testing said first acceleration event with a threshold circuit connected to said acceleration sensor to determine if said first acceleration event is above a predetermined minimum g-force level;

(c1b) determining if said first acceleration event persisted for a predetermined minimum interval; and (c1c) stimulating a first radio transmitter connected to said threshold circuit within said object unit to transmit a radio signal when said first acceleration event is above said predetermined minimum g-force level and persisted for said predetermined minimum interval.

34. A method for measuring a movable object according to claim 25 wherein said radio signal is modulated and has a transmission duration proportional to the g-force of each of said acceleration events.

35. A method for measuring a movable object according to claim 25 wherein said radio signal is modulated and has a datum of the g-force of each of said acceleration events.

36. A method for measuring a movable object according to claim 25 further comprising the following step (a0) performed before step (a1):

(a0) arming said monitor unit to use only the next two consecutive acceleration events detected and ignoring subsequent acceleration events until said monitor unit is reset.

37. A method for measuring a movable object according to claim 25 further comprising the steps of:

(h) arming said monitor unit to use the last two consecutive acceleration events detected; and (i) repeating steps (f) through (g).

38. A method for measuring a movable object according to claim 24 wherein step (g) is replaced by the following new step (g):

(g) calculating the height achieved by said movable object.

39. A method for measuring a movable object according to claim 38 wherein step (g) further comprises the steps of:

(g1) displaying said elapsed time of said movable object on an output display; and (g2) displaying said height achieved of said movable object on said output display.

40. A method for measuring a movable object according to claim 24 wherein step (g) further comprises the steps of:

(g1) displaying said elapsed time of said movable object on an output display; and (g2) displaying said speed of said movable object on said output display.

41. A method for measuring a movable object according to claim 40 further comprising the following step (g0) performed before step (g1):

(g0) comparing said speed calculated to a predetermined range, and performing steps (g1) and (g2) only when said speed calculated is within said predetermined range.

42. A method for measuring a movable object according to claim 24 wherein step (a) further comprises the following step (a1), step (b) further comprises the following step (b1), step (c) further comprises the following steps (c1) and (c2), step (e) further comprises the following step (e1), step (f) further comprises the following step (f1), and step (g) further comprises the following steps (g1), (g2), and (g3):

(a1) entering said distance between said two points through an input keypad of a monitor unit, wherein said distance is stored in a first processor within said monitor unit connected to said input keypad;

(b1) locating said acceleration sensor within an object unit wherein said object unit is secured to said movable object, and further wherein said monitor unit is located external to said object unit;

(c1) determining said first time for said first acceleration event by setting a first time stamp for said first acceleration event;

(c2) storing said first time stamp in a first position in a second processor connected to said acceleration sensor in said object unit;

(e1) determining said second time for said second acceleration event by repeating steps (c1) through (c2) for said second acceleration event of said movable object, wherein said first time stamp is moved to a second position in said second processor and a second time stamp is set for said second acceleration event and is stored in said first position in said second processor;

(f1) determining said elapsed time by subtracting said first time stamp stored in said second position from said second time stamp stored in said first position;

(g1) stimulating a first radio transmitter connected to said second processor to transmit a radio signal containing said elapsed time when said elapsed time falls within a predetermined range;

(g2) receiving said transmitted radio signal containing said elapsed time in a first radio receiver located in said monitor unit; and (g3) transferring said elapsed time from said radio receiver to said first processor connected to said radio receiver and calculating the speed of said movable object by dividing said distance by said elapsed time.

* * * * *